US006601631B1

(12) United States Patent
Miller et al.

(10) Patent No.: US 6,601,631 B1
(45) Date of Patent: Aug. 5, 2003

(54) DISPENSER FOR APPLYING A MATERIAL TO A SURFACE

(75) Inventors: Crispin M. Miller, Lincoln, MA (US); Jean L. Spencer, Boston, MA (US)

(73) Assignee: Berol Corporation, Freeport, IL (US)

( * ) Notice: Subject to any disclaimer, the term of this patent is extended or adjusted under 35 U.S.C. 154(b) by 87 days.

(21) Appl. No.: 09/635,972

(22) Filed: Aug. 10, 2000

Related U.S. Application Data

(63) Continuation-in-part of application No. 09/556,598, filed on Apr. 21, 2000, which is a continuation-in-part of application No. 09/390,965, filed on Sep. 7, 1999.

(51) Int. Cl.[7] ..... B32B 31/00

(52) U.S. Cl. ..... 156/577; 156/523; 156/579; 118/76; 242/160.4; 242/171; 242/588.6; 206/411

(58) Field of Search ..... 156/238, 523, 156/540, 574, 577, 579, 527; 242/160.2, 160.4, 170, 171, 588, 588.2, 588.3, 588.6; 225/46; 118/76, 200, 257

(56) References Cited

U.S. PATENT DOCUMENTS

| | | | | |
|---|---|---|---|---|
| 3,211,604 A | * | 10/1965 | Rymer | 156/577 |
| 3,945,837 A | | 3/1976 | Miyata et al. | 106/22 |
| 4,197,348 A | * | 4/1980 | Townsend | 156/169 |
| 4,198,445 A | | 4/1980 | Sokol et al. | 427/140 |
| 4,568,415 A | * | 2/1986 | Woltron | 156/185 |
| 5,006,184 A | | 4/1991 | Manusch et al. | 156/577 |
| 5,049,229 A | | 9/1991 | Czech | 156/577 |
| 5,310,437 A | | 5/1994 | Tucker | 156/238 |
| 5,393,368 A | | 2/1995 | Stevens | |
| 5,490,898 A | | 2/1996 | Koyama | 156/540 |
| 5,714,035 A | | 2/1998 | Stevens | |
| 5,820,728 A | | 10/1998 | Stevens et al. | 156/577 |
| D410,494 S | | 6/1999 | Hoffman | D19/69 |
| 6,112,796 A | * | 9/2000 | Stevens | 156/238 |
| 6,227,274 B1 | * | 5/2001 | Koyama et al. | 118/257 |

FOREIGN PATENT DOCUMENTS

| | | |
|---|---|---|
| DE | 2 216 951 | 10/1973 |
| DE | 41 04 333 A1 | 6/1992 |
| EP | 0 551 522 B1 | 3/1998 |
| JP | 401299880 A | 12/1989 |
| JP | 10/309892 | 11/1998 |

OTHER PUBLICATIONS

International Search Report in PCT/US00/23492 dated Jan. 4, 2001.

* cited by examiner

*Primary Examiner*—Mark A. Osele
(74) *Attorney, Agent, or Firm*—Marshall, Gerstein & Borun

(57) ABSTRACT

The invention features dispensers for applying a material, e.g., a tape, to a surface. For example, the invention features a dispenser for applying a material to a surface, including a housing, at least a major portion of which is substantially cylindrical; within the housing, a supply spool rotatable about an axis and a quantity of material stored on the supply spool in a plurality of widths wide; and, at one end of the housing, an applicator head about which the material is passed, the head being constructed to press the material against the surface, the head having an edge, over which the material passes, that is disposed at an angle of greater than 5 degrees relative to a plane that is perpendicular to the longitudinal center axis of the housing.

49 Claims, 23 Drawing Sheets

DISPENSER FOR APPLYING A MATERIAL TO A SURFACE

This application is a Continuation-in-Part of U.S. Ser. No. 09/556,598, filed Apr. 21, 2000, which was a Continuation-in-Part of U.S. Ser. No. 09/390,965, filed Sep. 7, 1999.

TECHNICAL FIELD

The invention relates generally to the field of dispensers, and in particular to dispensers from which a material is deposited onto a surface from a tape, e.g., a correction tape, stored in the dispenser.

BACKGROUND

Correction tape dispensers are used to apply a thin, white, opaque piece of correction tape over visible markings which have been made on a surface. Typically, the tape is used to cover a mistake in text on a piece of paper. After the tape has been applied over the mistake, the correct text can be written on top of the tape to fix the mistake.

U.S. Pat. No. 5,490,898 discloses a fairly typical arrangement of a correction tape dispenser (coating film transfer tool). The tool includes a case 2 formed in a flat box-like shape. Case 2 contains a pay-out reel 6 with a coating film transfer tape T wound thereabout, and a winding reel 7 for collecting the used tape T'. A tape drive D connects the two reels to maintain tension in the tape. The tape includes a backing layer which remains on the reels, and a covering layer for covering the visible image on the surface. Tape T passes around a transfer head H as the tape travels from reel 6 to reel 7. The arrangement of head H causes the tape covering layer to be deposited on the surface contacted by the tape while under pressure from the user.

Tape T and used tape T' are stored respectively on reels 6 and 7 in a multi-layer thick/single-layer wide arrangement. This way of storing the tape on the reels, and the arrangement of the reels relative to each other and to head H, causes the case to have the flat box-like shape. Having this case in such a shape is less than optimal for a correction tape dispenser. First, the case can at least partially block the user's view of the material being corrected. Second, users would find a dispenser shaped more along the lines of a writing instrument (e.g. a cylindrically shaped pen or pencil) more natural to use when correcting writing on paper.

U.S. Pat. No. 5,049,229 discloses an apparatus for the application of an adhesive film in which the supply reel 5 and take-up reel 11 are both mounted on a shaft or axis 9. The tape is stored on these reels in a manner similar to that described in the previous paragraph (i.e. a multi-layer thick/single-layer wide arrangement). Such an arrangement also results in an apparatus shape having the drawbacks mentioned at the end of the previous paragraph.

SUMMARY

The present invention is directed to overcoming one or more of the problems set forth above. Briefly summarized, according to one aspect of the present invention, a dispenser for applying a material to a surface includes a spool rotatable about an axis and a quantity of tape stored on the spool. The tape is passed around an applicator head, the head pressing the tape against a surface to deposit at least a portion of the tape on the surface. The applicator head is located substantially along the axis.

In preferred embodiments, the dispenser is similar in shape to a writing instrument, and thus may be naturally and comfortably wielded by a user of the dispenser.

In one aspect, the invention features a dispenser for applying a material to a surface, including a housing, at least a major portion of which is substantially cylindrical; within the housing, a supply spool rotatable about an axis and a quantity of material stored on the supply spool in a plurality of widths wide; and, at one end of the housing, an applicator head about which the material is passed, the head being constructed to press the material against the surface, the head having an edge, over which the material passes, that is disposed at an angle of greater than 5 degrees relative to a plane that is perpendicular to the longitudinal center axis of the housing.

Preferred implementations of this aspect of the invention may include one or more of the following features. The edge is disposed at an angle of greater than 10 degrees relative to the plane. The edge is disposed at an angle of from about 5 to 30 degrees, and more preferably an angle of from about 10 to 20 degrees, e.g., about 15 degrees. The longitudinal center axis of the housing passes within 1 mm of the lengthwise midpoint of the edge, more preferably through the midpoint. The applicator head exhibits flat-wise flexure when pressed against a surface. The applicator head exhibits edge-wise flexure when pressed against a surface. The edge is defined by a member that is mounted on a flexible tongue. The material is a correction tape. The applicator head is constructed to pivot about an axis. The applicator head pivots about the axis of rotation of the supply spool.

In another aspect, the invention features a dispenser for applying a material to a surface, including a housing, at least a major portion of which is substantially cylindrical; within the housing, a supply spool rotatable about an axis and a quantity of material stored on the supply spool in a plurality of widths wide, the axis of rotation of the spool being substantially parallel to the longitudinal axis of the housing; and, at one end of the housing, an applicator head about which the material is passed, the head being constructed to press the material against the surface. The head has an edge, over which the material passes, that is positioned so that its lengthwise midpoint is in the vicinity of the longitudinal center axis of the housing so that the housing will not tend to rotate about its longitudinal center axis when the edge is pressed against a surface during use.

Preferred implementations of this aspect of the invention may include one or more of the following features. The midpoint is within 1 mm of the longitudinal center axis, more preferably the midpoint lies on the longitudinal center axis. The material is a correction tape.

In another aspect, the invention features a dispenser for applying a material to a surface, including a housing, at least a major portion of which is substantially cylindrical; within the housing, a supply spool rotatable about an axis and a quantity of material stored on the supply spool in a plurality of widths wide, the axis of rotation of the spool being substantially parallel to the longitudinal axis of the housing; and, at one end of the housing, an applicator head about which the material is passed, the head being constructed to press the material against the surface, the head having a burnishing member defining an edge over which the material passes. The burnishing member is mounted on a cantilevered tongue so as to allow the burnishing member to flex flat-wise when the edge is pressed against a surface.

Preferred implementations of this aspect of the invention may include one or more of the following features. The tongue is constructed to allow the burnishing member to flex edge-wise when the edge is subjected to an edge-wise load. The edge is disposed at an angle of greater than 5 degrees relative to a plane that is perpendicular to the longitudinal center axis of the housing. The longitudinal center axis of the housing passes within 1 mm of the lengthwise midpoint of said edge, preferably the longitudinal center axis of the housing passes through the lengthwise midpoint of said edge.

In another aspect, the invention features a dispenser for applying a material to a surface, including (a) a supply spool rotatable about an axis; a quantity of unused tape stored on the supply spool; (b) an applicator head about which the tape is passed, the head pressing the tape against a surface to deposit a transfer layer of the tape onto the surface, the head defining an edge over which the tape passes, the edge being disposed at an angle of greater than 5 degrees relative to a plane that is perpendicular to the longitudinal center axis of the housing; (c) a housing which surrounds at least a majority of the tape, a substantial portion of the housing being substantially cylindrical in shape; and (d) a support surface constructed to support the tape as it moves from the supply spool to the edge in a manner that prevents the tape from being subjected to a significant edgewise load.

Preferred implementations of this aspect of the invention may include one or more of the following features. The support surface includes a substantially continuous surface. The support surface includes a ramped portion and a conical portion. The support surface includes a discontinuous, segmented surface. The segmented surface comprises a series of spaced guides, posts or pegs. The material comprises a correction tape, carrying a transfer layer on one surface. The support surface is configured to support the tape only on the surface opposite the surface carrying the transfer layer.

In a further aspect, the invention features a dispenser for applying a material to a surface, including (a) a supply spool rotatable about an axis; (b) a quantity of unused tape stored on the supply spool; (c) an applicator head about which the tape is passed, the head pressing the tape against a surface to deposit a transfer layer of the tape onto the surface, the head defining an edge over which the tape passes; (e) a housing which surrounds at least a majority of the tape; and (f) a support surface constructed to support the tape as it moves from the supply spool to the edge to allow the orientation of the vector normal to the plane of the tape to change from substantially parallel to the edge to substantially perpendicular thereto over an axial distance of less than about 30 mm.

Preferred implementations of this aspect of the invention may include one or more of the following features. The longitudinal axis of the tape is curved during the change of orientation. The support surface is configured to allow the change of orientation to occur within a radial distance of less than about 5 mm from the longitudinal axis of the housing. The material comprises a correction tape, carrying a transfer layer on one surface. The support surface is configured to support the tape only on the surface opposite the surface carrying the transfer layer.

In yet another aspect, the invention features a dispenser for applying a material to a surface, including (a) a supply spool rotatable about an axis; (b) a quantity of unused tape stored on the supply spool; (c) an applicator head about which the tape is passed, the head pressing the tape against a surface to deposit a transfer layer of the tape onto the surface, the head defining an edge over which the tape passes, the edge being disposed at an angle of greater than 5 degrees relative to a plane that is perpendicular to the longitudinal center axis of the housing; (d) a housing which surrounds at least a majority of the tape, a substantial portion of the housing being substantially cylindrical in shape; and (e) a support surface constructed to support the tape as it moves from the supply spool to the edge, the support surface being configured so that both edges of the tape travel the same distance as the tape moves between the supply spool and the edge.

Preferred implementations of this aspect of the invention may include one or more of the following features. The material comprises a correction tape, carrying a transfer layer on one surface. The support surface is configured to support the tape only on the surface opposite the surface carrying the transfer layer.

Other features and advantages of the invention will be apparent from the description and drawings, and from the claims.

DESCRIPTION OF DRAWINGS

FIG. 7(*a*) is a side view of the correction tape dispenser of FIG. 7 with the tape and a portion of the housing omitted for clarity;

FIG. 7(*b*) is a cross-sectional view of the correction tape dispenser of FIG. 7(*a*), taken along line B—B;

FIG. 9(*a*) is a perspective view of a correction tape traveling along the tape bed shown in FIG. 9;

FIG. 13(*a*) is a partial further enlarged perspective view of the tip portion of FIG. 13, with a portion of the tongue and burnishing member cut away;

FIG. 14(*a*) is view similar to FIG. 14, but taken from a different orientation, showing the axes of rotation of the tongue portion;

DETAILED DESCRIPTION

Figure 1:
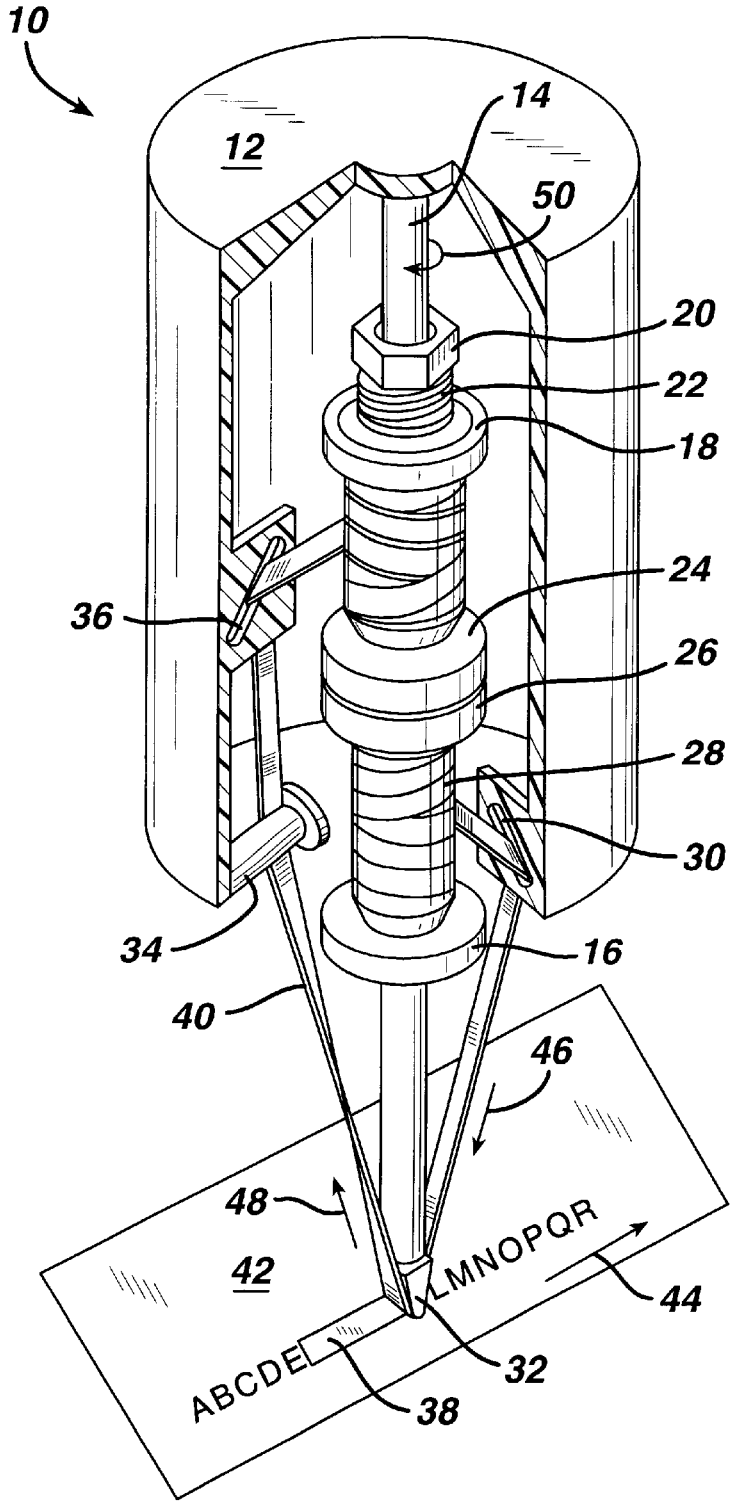
FIG. 1 is a perspective view of a first embodiment of a correction tape dispenser according to the invention.

Beginning with FIG. 1, a correction tape dispenser 10 includes a housing 12, a portion of which has been removed to facilitate viewing of the inside of the dispenser. The housing is preferably made of plastic and is substantially cylindrical in shape. An axle 14 extends down from the top of the housing. A cross section of housing 12 taken perpendicular to the axle is preferably circular or oval in shape (the housing diameter has been exaggerated for clarity). The axle is fixed to the housing such that it can either (a) rotate about its long axis, or (b) not rotate about its long axis. If the axle is rotatable, this allows an applicator head 32 secured to an end of the axle to rotate freely about the long axis of the axle. Alternatively, the axle can be arranged to be manually rotated to fixed orientations about its long axis by a detent mechanism (not shown) so that the head can be rotated or swiveled to fixed orientations about the long axis of the axle.

A supply spool 16 and a take-up spool 18 are rotatably supported on axle 14. The spools are secured together by a nut 20 and spring 22, and a flange 24 of spool 18 and a flange 26 of spool 16 interface to form a clutch between the two spools (operation of the nut, spring and flanges will be explained in more detail below with respect to FIG. 3). As a result, spools 16 and 18 are movable in unison along axle 14 and can rotate freely about the axle, although the clutch provides some resistance to the spools rotating about the axle relative to each other.

A supply of unused correction tape 28 is stored on spool 16. The tape has a thickness, width and length, and is stored on spool 16 in a plurality of layers thick and a plurality of widths wide (similar to thread on a spool). The tape may be wound helically, as will be discussed below, or in any suitable manner. Preferably the tape has a width to length ratio of 0.01 or less. Tape 28 is guided off spool 16 by a first guide slot 30 which extends inward of the housing. The tape then passes around an applicator head 32, past a guide bar 34, through a second guide slot 36, and onto take-up spool 18. Head 32 is preferably made of plastic, thus allowing the head to flex during use.

Head 32 is at least partially located within an imaginary cylindrical space of unlimited length generated around axis 14. The radius of this cylindrical space is equal to the radius of the large spool when this spool is full (in this case the take-up spool). If the two spools were not coaxial, then this cylindrical space would be generated around the axis of the spool closer to head 32, with the radius of the cylindrical space equal to the radius of the spool when this spool is full.

As is well known in the art, the tape includes a masking layer 38 and a backing layer 40. To use the dispenser, a user grasps housing 12, presses head 32 against a surface 42 (in this case the head contacts surface 42 just after the letter "E"), and moves the dispenser in the direction of an arrow 44. This causes tape 28 to unwind from spool 16, move in the direction of arrows 46 and 48, and wind up on spool 18. This tape movement causes the spools to rotate in the direction of arrow 50. The tape movement also causes the spools to move up or down along axis 14 because guide slots 30, 36 are fixed on the housing and the tape unwinds from spool 16 back and forth from one end of the spool to the other. Rather than a masking layer, the tape may alternatively carry a layer of material for highlighting, marking, labeling, transferring decals, scenting, gluing, bonding, adhering, removing debris, or applications in the cosmetic and medical areas.

Alternatively, the spools can be fixed so that they do not move up and down along axis 14 while guides 30, 36 are each mounted for coordinated movement on a rod (not shown) which is parallel to axis 14. In this case, the guides will move up and down on their respective rods as the tape unwinds from supply spool 16 and rewinds onto take-up spool 18 while the spools themselves will not move up and down along the axis.

As is well known in the art, the adherence of masking layer 38 to surface 42 (e.g. one side of a piece of paper) is greater than the adherence of masking layer 38 to backing layer 40. As a result, masking layer 38 peels away from backing layer 40 and adheres to surface 42, covering up some letters in the process. When the dispenser is lifted off surface 42, masking layer 38 on surface 42 tears free from the masking layer still on tape 28.

The diameter of the take-up spool is greater than the diameter of the supply spool. The reason for this diameter difference is to enable the take-up spool to rewind the backing layer faster than the new tape is being paid out from the supply spool, thereby taking up any slack that may inadvertently be created at head 32. This diameter difference would cause a continual stretching of the tape as the dispenser is used, but the clutch between the two spools 16, 18 relieves this tension buildup and maintains a fairly constant tension in tape 28.

Figure 2:
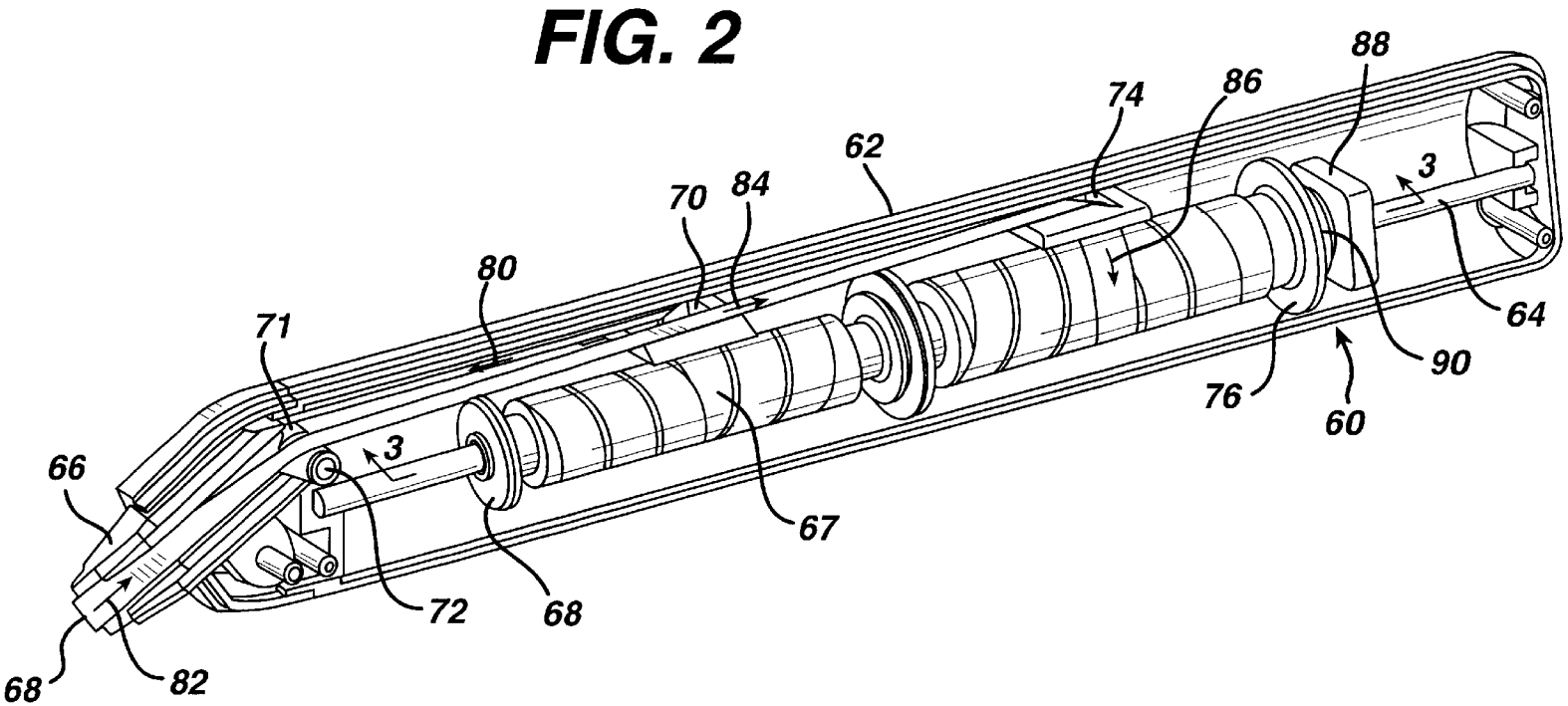
FIG. 2 is a perspective view of a second embodiment of a correction tape dispenser.
Figure 3:
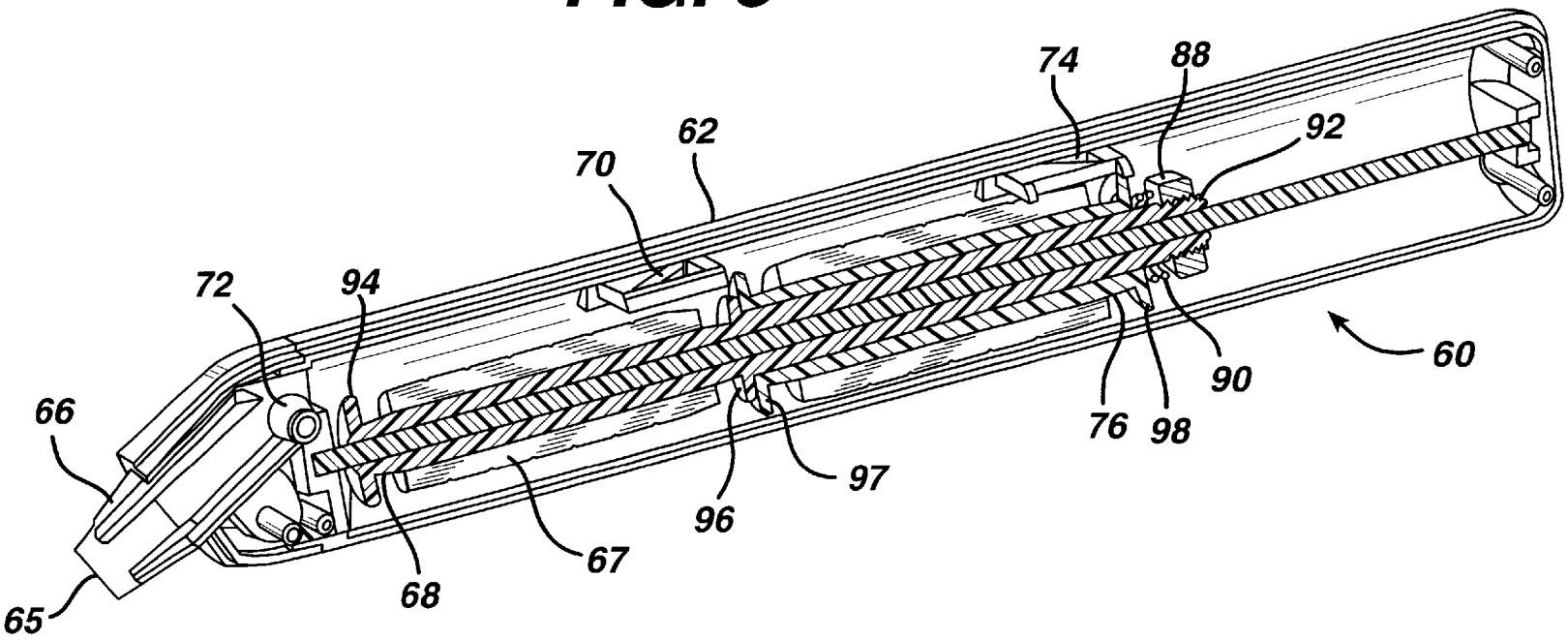
FIG. 3 is a partial sectional view of FIG. 2 taken along the lines 3—3.

Turning to FIGS. 2 and 3, a second embodiment of the invention will be described. Many of the features of this embodiment are similar to features found in the first embodiment. A correction tape dispenser 60 includes a housing 62 which is substantially cylindrical (having a circular or oval cross section) along most of its length (one half of the housing is not shown to facilitate viewing of the inside of the dispenser). The dimensions of this housing are similar to those of a writing instrument such as a porous-tip marker. The design can be altered so that the housing dimensions approach those of a traditional pen.

In this embodiment an axle 64 is secured to a forward and rearward part of the housing. The axle does not rotate about its long axis. An applicator head 66 is secured to the housing rather than to the axle as in FIG. 1. Although head 66 is shown as having an edge 65 about which the tape is wrapped, edge 65 could be replaced by an alternative arrangement such as a cylindrical roller. Edge 65 lies on a line of contact between the tape and the surface being corrected. This line extends in a direction that intersects the axis about which the spools rotate. In this embodiment the line and axis intersect at an acute angle, while in the FIG. 1 embodiment, they intersect at a right angle. In other embodiments, the line may pass near the axis without intersecting it.

The path of tape 67 in this embodiment has some similarities to the tape path in the first embodiment (FIG. 1). The tape unwinds from a supply spool 68 and passes through a guide slot 70. The tape then travels down the dispenser, passes over a peg-shaped guide 71 (FIG. 2) and twists about 90 degrees about its longitudinal axis behind head 66 as viewed in FIGS. 2 and 3. Guide 71 is tapered and somewhat conical (a truncated cone) to facilitate the tape veering toward a midplane of the dispenser. After wrapping around head 66, tape 67 again twists about 90 degrees about its longitudinal axis, and passes over another peg-shaped guide 72 which is similar in shape to guide 71. The tape then extends over guide slot 70 and passes through a second guide slot 74, after which the used tape is wound onto take-up spool 76. With the tape coming off the side of spool 68 facing the housing (as shown in FIG. 2), arrows 80, 82, 84 and 86 indicate the path of travel of the tape. In both this embodiment and the embodiment of FIG. 1, each tape layer wound on the spool is in the form of a helix traversing substantially a full axial length of the winding region of the spool.

With reference to FIG. 3, operation of a nut 88 and spring 90 along with spools 68 and 76 will be described. This assemblage holds the two spools together to form a clutch between the spools. Spool 68 actually extends all the way through spool 76 and ends in a threaded portion 92. Spool 68 has a flange 94 at one end and a flange 96 about midway along the spool. Spool 76 surrounds spool 68 and includes a flange 97 at one end and a flange 98 at the other end. Nut 88 is screw-threaded onto threaded end 92 of spool 68 to press spring 90 against flange 98 of spool 76. This arrangement presses flanges 96 and 97 against each other, forming a friction clutch. In this embodiment there is minimal friction between spool 68 and axle 64.

Operation of the dispenser of FIGS. 2 and 3 is essentially the same as for the dispenser of FIG. 1. The tape is maintained under tension and travels from spool 68, around head 66, and back to spool 76. This tape movement causes the spools to rotate about axle 64, with the clutch allowing the spools to slip rotationally relative to each other to maintain tape tension fairly constant. The tape movement also causes the spools to move in unison up and down on axle 64 as the tape unwinds from spool 68 and rewinds on spool 76.

FIGS. 6(*a*)–(*d*) show some of the possible applicator head orientations. A head 130 in FIG. 6(*a*) is similar to head 66 in FIGS. 2 and 3 in that the center of head edge 132 is below a centerline 134 of a housing 136. FIG. 6(*b*) discloses a head 138 in which the center of a head edge 140 is along centerline 134 of a housing 142. FIG. 6(*c*) discloses a head 144 in which a centerline 145 of head 144 is parallel to a centerline 146 of a housing 148. FIG. 6(*d*) discloses a head 150 in which a centerline of the head and centerline 146 of housing 152 are collinear.

The four head positions shown in FIGS. 6(*a*)–(*d*) can be defined by an angle between a centerline of the head and the centerline of the housing, and by the perpendicular distance from the centerline of the housing to the midpoint of the head edge. There could be many more head orientations defined by these two parameters. In addition, the head can be made to swivel freely along the angle to fixed settings. The head could also be made to swivel freely around its centerline while it is swiveling freely along the angle.

Figure 4:
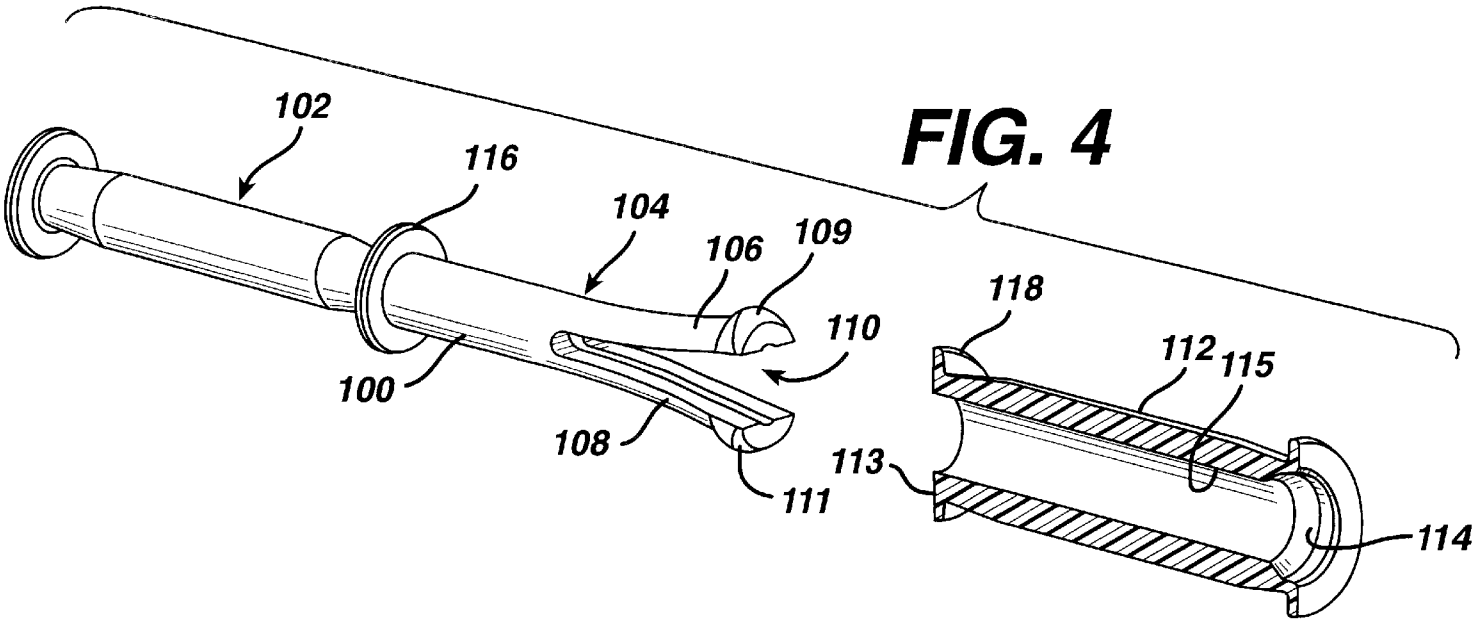
FIG. 4 is a partial sectional exploded view of an alternative pair of spools usable in the invention.
Figure 5:
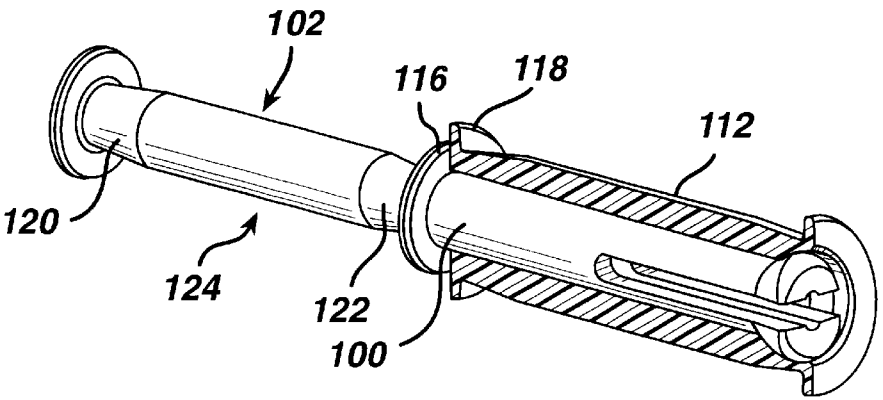
FIG. 5 is a partial sectional view of the spools of FIG. 4 assembled together.
Figure 6B:
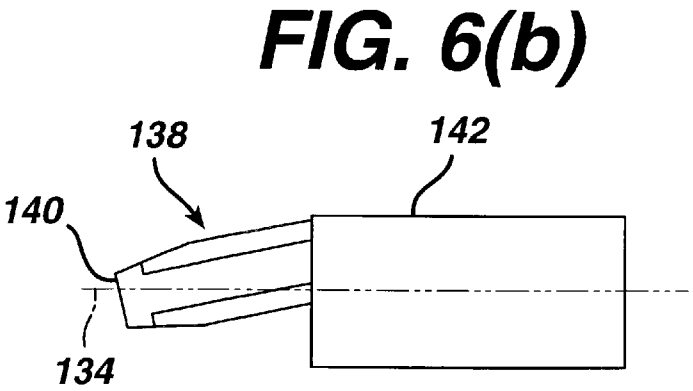
FIGS. 6(*a*)–(*d*) are schematic side views showing various orientations of an applicator head to its housing.
Figure 6D:
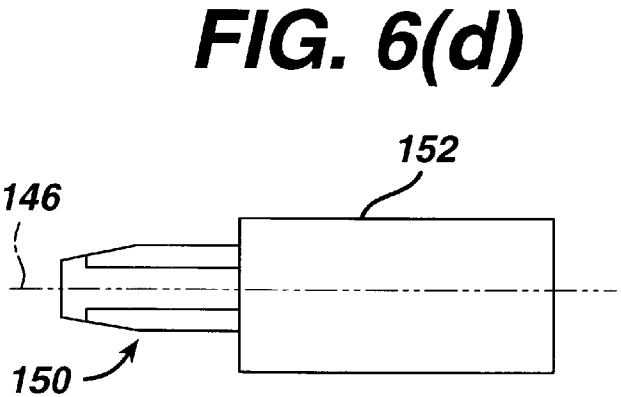
Figure 6A:
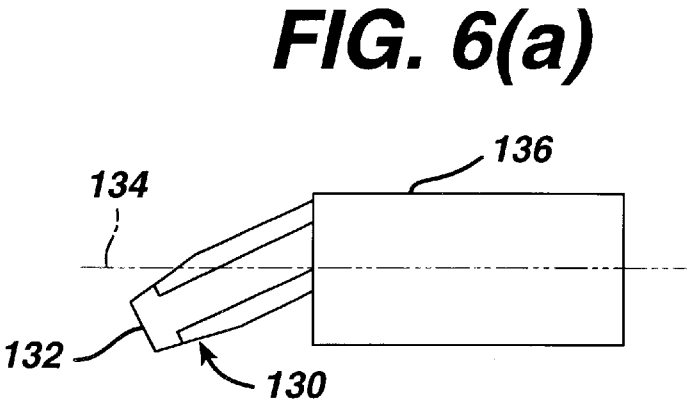
Figure 6C:
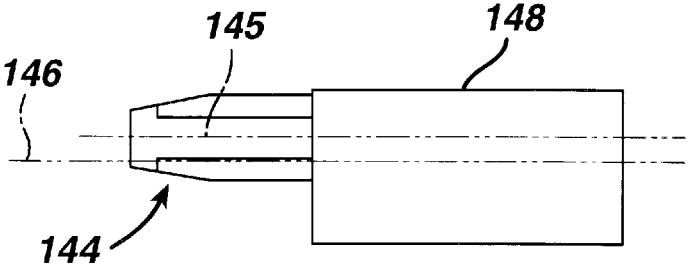

Turning to FIGS. 4 and 5, an alternative embodiment of the spools is disclosed. A. supply spool 100 is similar in its lower end 102 to spool 68. The upper end 104 of the spool however is different. Spool 100 is made of plastic and is injection molded to have the shape shown in FIG. 4. Spool 100 is partially split lengthwise at end 104 and has a pair of arms 106 and 108. Spool 100 is molded to have a gap 110 between the arms, and a flared portion 109, 111 at the end of each arm. A take-up spool 112 is similar to spool 76 except that an internal annular recess 114 is provided at one end of the spool (half the take-up spool is not shown to facilitate viewing).

Spools 100 and 112 are assembled by pressing arms 106, 108 together and inserting them into an end of spool 112. Gap 110 between the arms allows them to compress sufficiently to fit through spool 112. Spool 100 is inserted into spool 112 until flared portions 109, 111 of the arms spring outward into annular recess 114 due to the inherent spring characteristics of the arms. Portions 109, 111 and recess 114 hold the spools together. Radially outward force by arms 106 and 108 on surfaces 114 and 115 of take-up spool 112 creates friction between upper spool end 104 and take-up spool 112 to form a friction clutch. Some frictional resistance can also be provided between flanges 116 and 118. This embodiment eliminates the nut and spring of the earlier embodiments.

Referring to FIG. 5, each end portion 120, 122 of a winding region 124 of spool 100 decreases in diameter towards its respective spool end to stabilize a turn in the winding at the end of each layer, in which turn, if the tape is wound helically, a helix angle of the wound tape reverses, and to facilitate that reversal of helix angle between one helical layer and the next helical layer which spirals in the opposite direction. In other words, the maximum winding diameter of each spool (without any tape on the spool) is in the central region of the spool. This same feature is found on spool 112 and the other spools discussed above.

Figure 7:
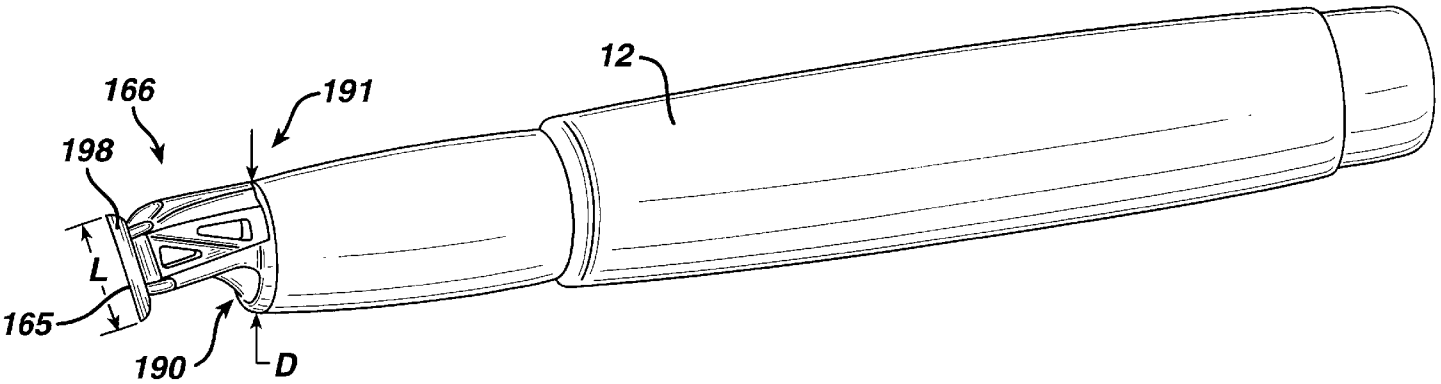
FIG. 7 is a perspective view of a correction tape dispenser according to an alternate embodiment of the invention.
Figure 7A:
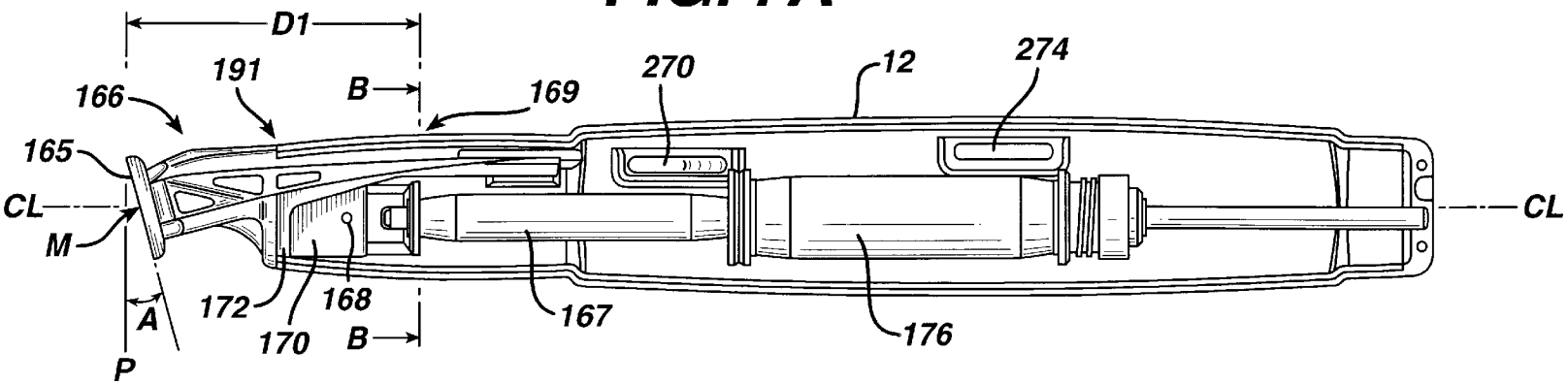
Figure 7B:
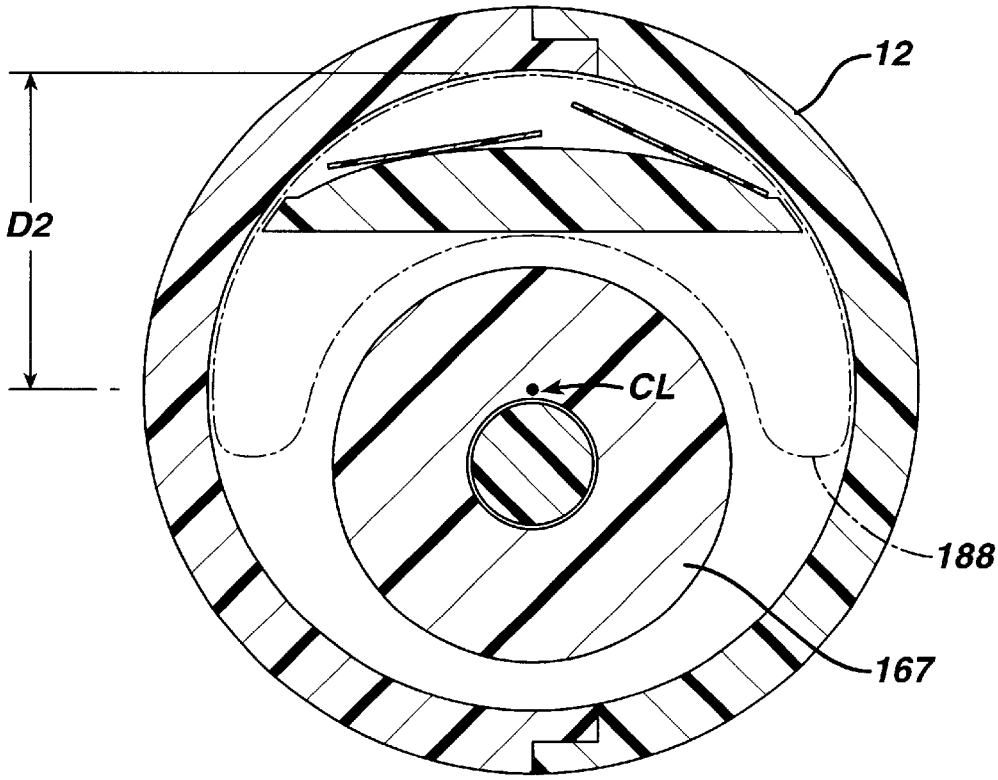

An alternate embodiment of the invention is shown in FIGS. 7–7A. In this embodiment, the edge 165 of head 166 is disposed at an angle A with respect to a perpendicular (P) to the centerline CL (longitudinal axis) of the housing 12. Preferably, angle A is from about 5 to 30 degrees, more preferably about 10 to 20 degrees. The angled edge allows the user to comfortably apply the tape to a paper surface while holding the housing in an ergonomic position. It is also preferred that the lengthwise midpoint M of the edge 165 lie on or relatively close to the centerline of the housing, e.g., within 1 mm of the centerline, more preferably within 0.5 mm, and most preferably on the centerline. This positioning of the edge allows the edge to be pressed against a surface without the housing 12 tending to rotate in the user's hand (if the above constraints are not met, the off-center force resulting from pressing the edge against a surface will exert a rotational moment with respect to the centerline of the housing, requiring extra effort to keep the housing from turning in the user's hand).

Preferably, edge 165 is relatively long, as shown, to give added stability and help the user orient the edge on the paper. This feature may also help to prevent the tape from slipping off the edge during use. The length L of edge 165 is preferably at least 9 mm, more preferably from about 9–15 mm, and most preferably from about 10–12 mm.

The dispenser shown in FIGS. 7–7A also includes tape guides 270, 274, which reorient the tape as it passes from the supply spool 167 to the edge 165, and again as the tape backing runs from the edge to the take-up spool 176. These tape guides are preferably formed of a low surface-energy material, e.g., a polytetrafluoroethylene (PTFE) polymer such as TEFLON polymer. A preferred geometry for tape guides 270, 274 will be described below with reference to FIGS. 16–20.

Figure 8:
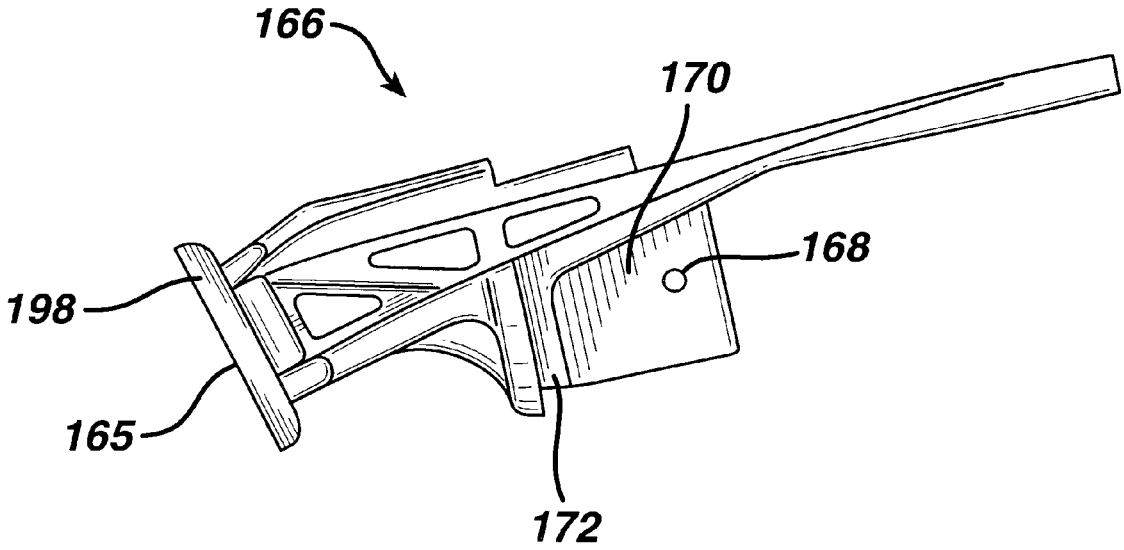
FIG. 8 is a side view of the tip portion of the correction tape dispenser of FIG. 7.

As shown in FIG. 8, head 166 is preferably a modular unit that is molded separately and assembled into the housing during manufacture of the dispenser. In the embodiment shown in FIGS. 7 and 8, the head is located within the housing and pinned in place using guide aperture 168 located on guide member 170. Guide member 170 is sandwiched between two clam-shell halves of the housing and secured in place by a pin (not shown) inserted through guide aperture 168. The positioning of the head 166 relative to housing 12 is further guided by the engagement of surface 172 with the circular opening of housing 12. Edge 165 is defined by a burnishing member 198. Preferably, at least the burnishing member 198 is transparent, so that the user can look through the burnishing member to see the marking being corrected. For ease of manufacture, preferably the entire head 166 is formed of a transparent plastic.

The edge positioning described above requires the tape to travel in a non-planar path as it runs between the spool 167 (FIG. 7A) and the edge 165, and again as the tape backing runs from the edge to the take-up spool 176 (i.e., as the tape moves through both "runs" of the tape path). The travel to the edge 165 and back should be accomplished without tearing, stretching or otherwise distorting or damaging the tape, and thus it is important that the tape not encounter any significant edge-wise loads (by "significant", we mean sufficient to cause damage to or distortion—such as wrinkling—of the tape). Also, the tape should not be drawn off its intended path, as this could lead to malfunctioning of the dispenser; and the tape path must have as smooth a shape as practicable, to minimize drag on the motion of the tape.

To keep the pen-like form of the housing as slender as possible, both runs of tape—from the supply spool to the tip, and from the tip back to the takeup spool—should pass through the housing on the same side of the spools, e.g., as shown in FIG. 7(*b*). Thus, as the tape passes in each direction past the forward end 169 of the space provided in the housing for the spool 167 to travel toward edge 165, both runs of tape must pass through a crescent-shaped opening 188 (indicated in dotted lines) between the housing and the space reserved for the spool. For the position and orientation of the tip 166 shown in FIG. 7, this travel between opening 188 and edge 165 will also entail a need for the orientation of the tape (as defined by a vector normal to its surface) to rotate through nearly 90 degrees between opening 188 and the parts of the run approaching or leaving edge 165.

The degree of the inclination angle of edge 165 in this product configuration (for example, as discussed above, in the embodiment shown in FIG. 7, the angle A is preferably greater than about 5 degrees), and the need for the tape to pass through opening 188, combined with the need for a tape path that will minimize edgewise loads and deviation of the tape from its path, make it generally necessary to guide the tape along a specific non-planar course designed to meet these constraints. Because the inclination of edge 165 causes the lower end of edge 165 to be closer than the upper end to opening 188, the tape path should be designed to compensate for this distance discrepancy so as not to create a corresponding discrepancy in the path lengths of the two edges of the tape. That is, the tape path should be arranged so that, over some portion of its axial travel distance, the lower edge of the tape traverses more path length than does the upper edge of the tape, to "use up" some length of the lower edge of the tape and "draw in" (rearward) the forward extreme of the lower edge of the tape's travel (where the tape substantially reverses its direction upon reaching the burnishing edge 165). In this manner, both edges of the tape will have traveled the same path length by the time they reach edge 165, and therefore will have equal tension around edge 165, despite the upper and lower portions of edge 165 not being spatially equidistant from opening 188. In contrast, if the tape were simply suspended in midair as it traveled between the opening 188 and the edge 165, one edge of the tape would be pulled tighter than the other edge, creating an edgewise load on the tape.

Thus, the tape should "see" its path as "straight," in the sense that the tape can follow it without either edge of the tape being left slack or required to stretch, i.e., both edges of the tape should travel substantially the same distance throughout the tape path, so that the tension on both edges will be substantially the same, and the tape will not experience any significant edgewise load. A tape path meeting this criterion may be created by supporting the tape over at least a major portion of its path with a surface having a geometry that will provide the required equalization of path lengths.

The preferred shape of the housing 12 imposes an additional constraint on the axial distance that the tape can travel from the tip edge 165 before it changes its orientation. So that the dispenser can be gripped at a location reasonably near the edge 165, the housing should enclose the tape until near the edge (e.g., about 15 mm from the midpoint M of the edge). Also, the housing is preferably circular in cross-section in the gripping region and has an external diameter D of less than 14 mm at the forward end 191 of the gripping region. These design considerations require that both tape runs also fit within an opening 190 of limited size (e.g., having a 12 mm internal diameter) at the forward end 191 of the gripping region.

Thus, the compensation in tape edge path length must be accomplished over a relatively short axial distance D1 (i.e., the axial distance between opening 188 and the edge 165), and within a relatively short radial distance D2 from the housing axis CL (i.e., the radial distance between CL and the outer limits of openings 188). Generally, D1 is less than 60 mm and D2 is less than 10 mm. In preferred dispensers, D1 may be less than about 50 mm and D2 may be less than 6 mm.

Figure 9:
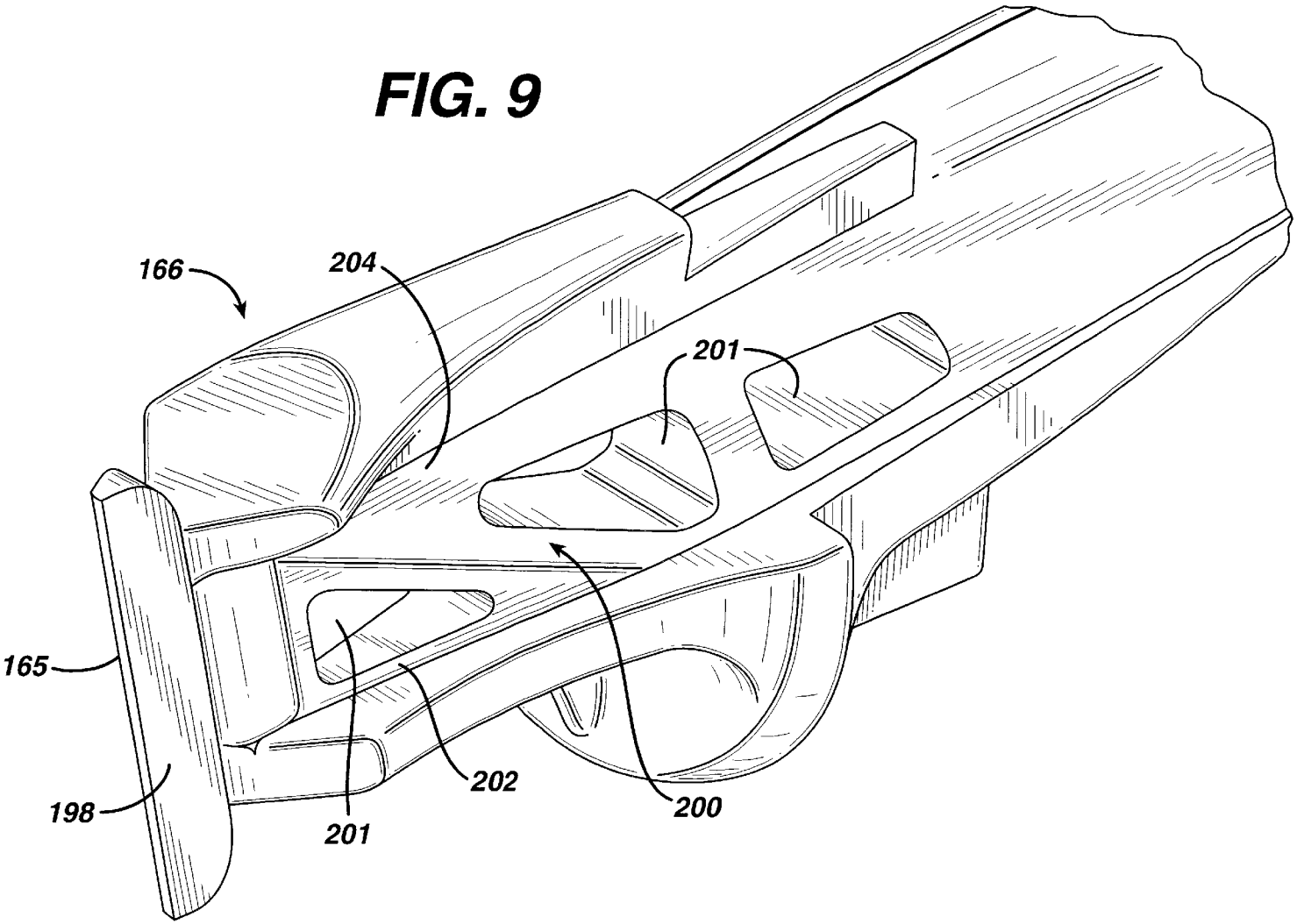
FIG. 9 is a partial enlarged perspective view of the tip portion, showing the tape bed.
Figure 9A:
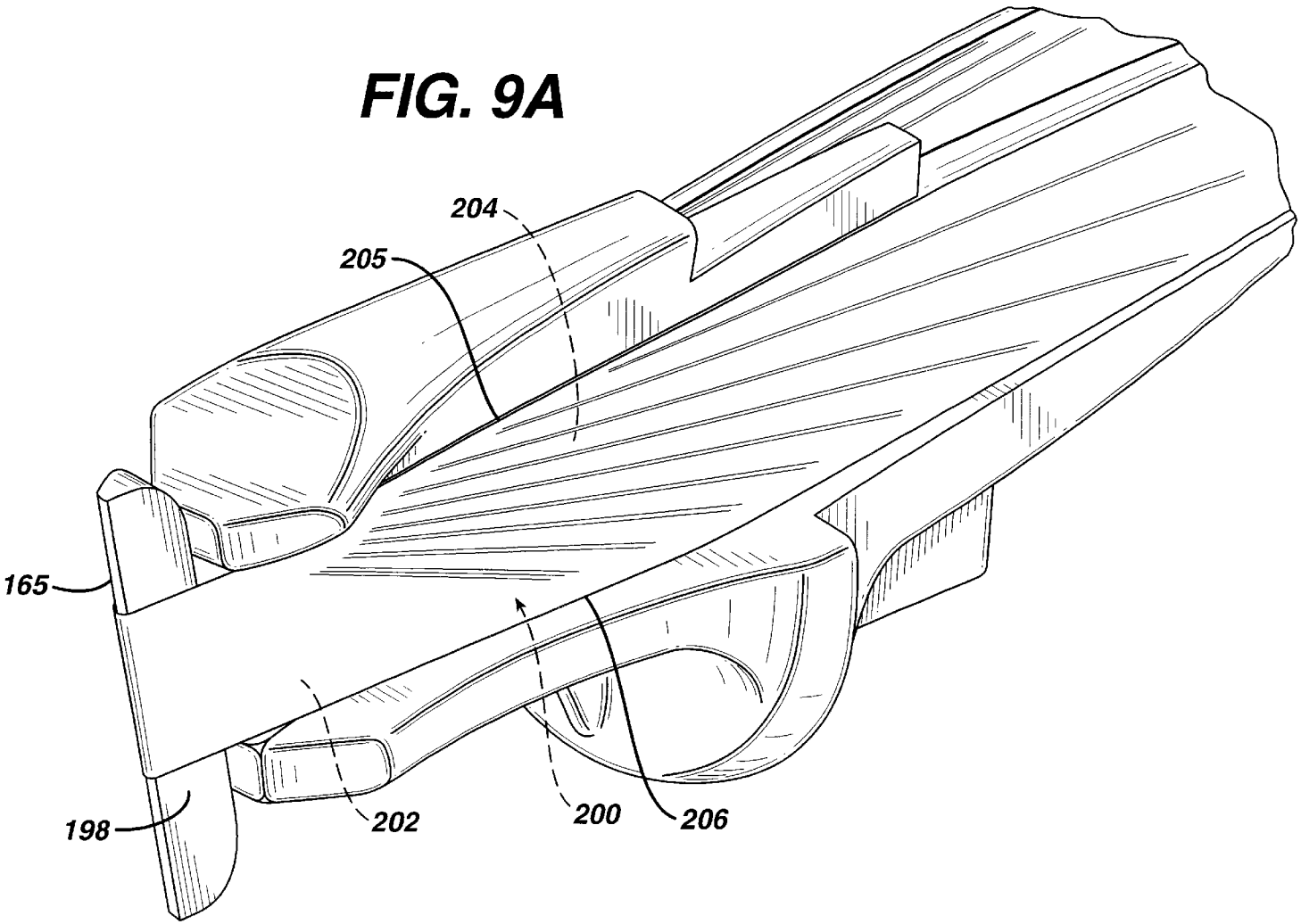
Figure 10:
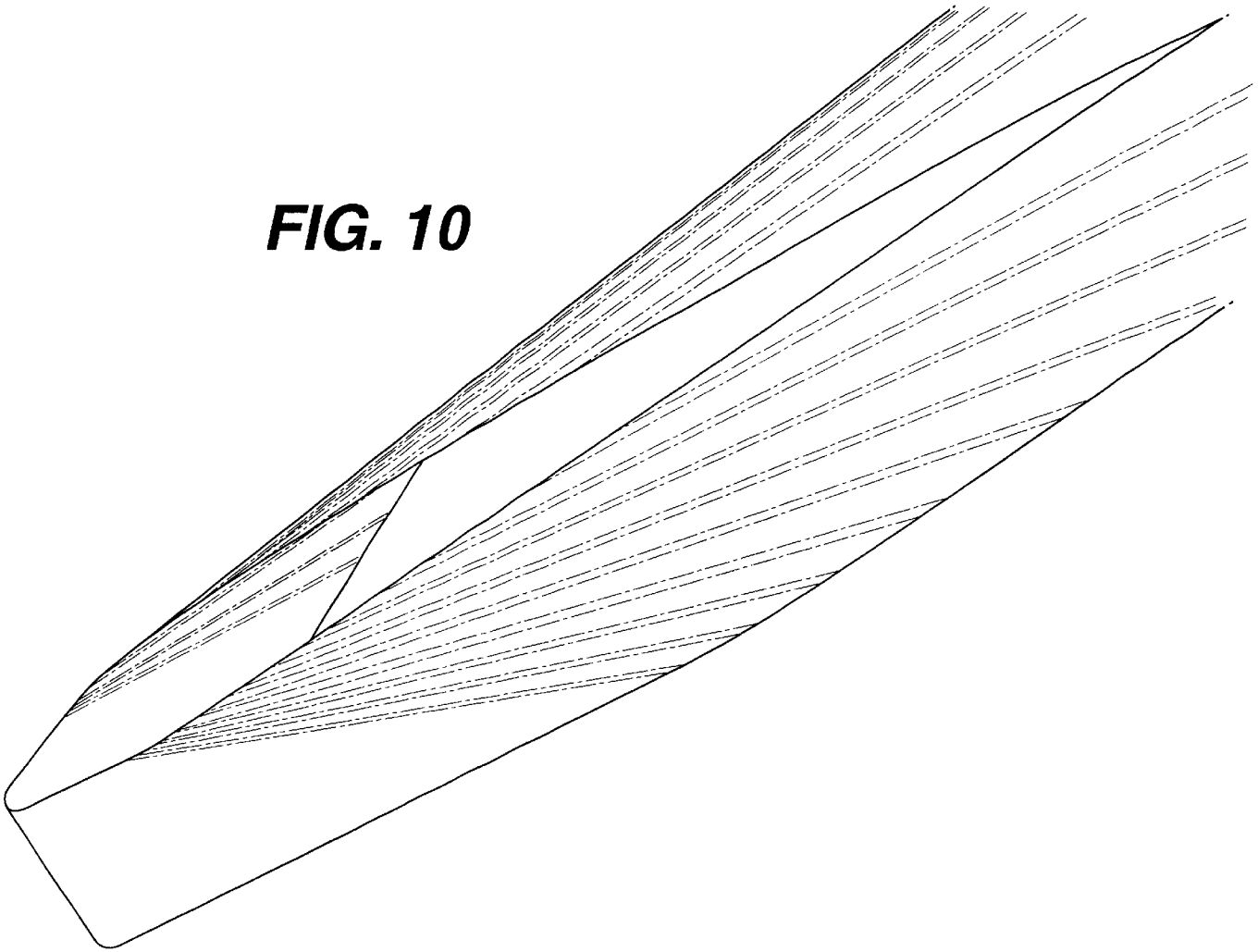
FIGS. 10 and 10(*a*) are, respectively, a perspective view and a top view of the shape of the correction tape as it travels along the tape bed in the path shown in FIG. 9(*a*)
Figure 10A:
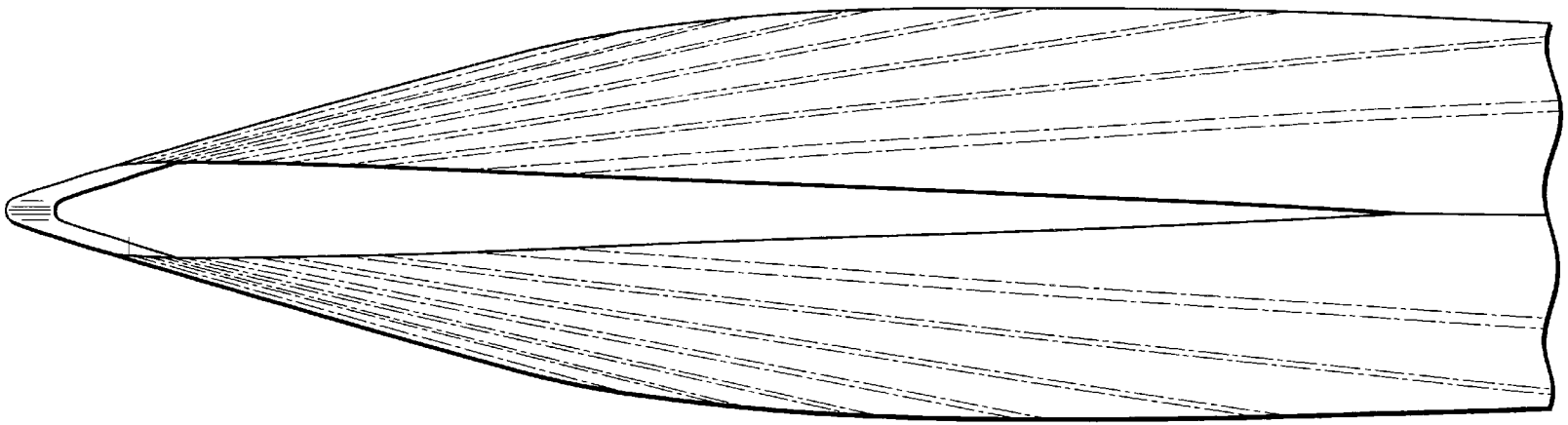

An example of a dispenser tip having a tape path meeting these criteria is shown in FIGS. 9 and 9A. In this embodiment, the tape bed 200, i.e., the surface of the head 166 over which the tape backing travels from edge 165 to spool 176, includes a ramped portion 202 and a portion 204 comprising a section of a cone (FIG. 9). Thus, the tape backing is guided, by this surface geometry of tape bed 200, in the path shown in FIGS. 9A, 10 and 10A (in FIGS. 10 and 10A the tape is shown alone, for clarity). The bulging of tape edge 206 due to its passage over conical portion 204 causes the tape edge 206, which would otherwise travel a shorter path length than the opposite tape edge 205, to travel a substantially equal path length. Meanwhile the curvature of the conical surface 204 is highly compatible with the curvature of the opening 190 through which the tape path must fit. The opposite tape bed surface (not shown), over which the tape travels from spool 167 to edge 165, may be generally symmetrical to tape bed 200, or may have a different geometry that guides the tape in a similarly shaped path. In the embodiment shown in FIG. 9, the tape bed 200 includes open areas 201. These open areas are provided to facilitate molding of the head 166. The openings may be omitted if not needed for molding purposes, or may be of different shapes and sizes, provided the tape bed 200 has sufficient remaining surface area to support the tape in the desired tape path.

Figure 11:
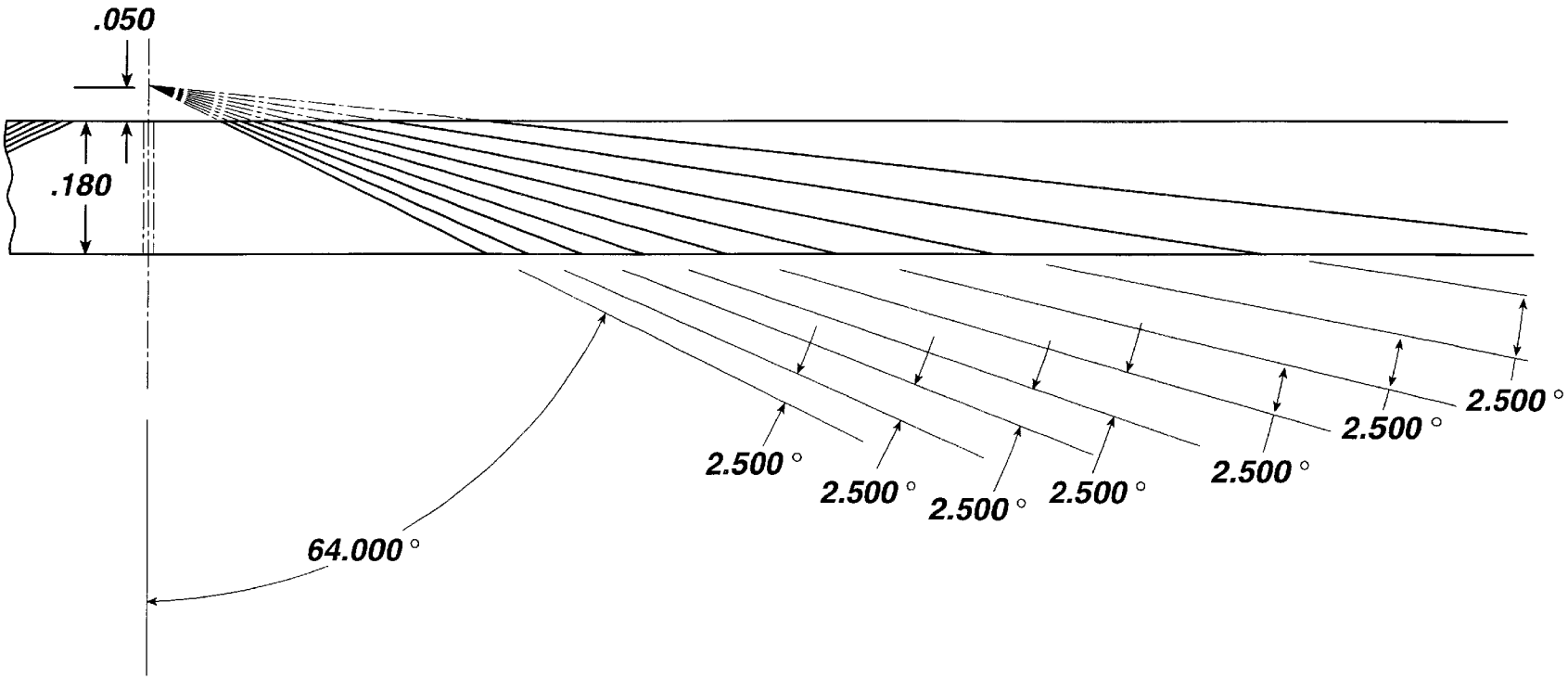
FIG. 11 is a diagram showing the layout of a pattern of bends that will give the tape path shown in FIGS. 9(*a*), 10 and 10(*a*)

Other suitable tape bed geometries and tape paths can be designed using CAD software to simulate the bends that are created in the tape as it travels through its path and inputting selected values for angle A and distances D1 and D2 for the desired dispenser design. For example, the conically-curved path followed by the tape in FIGS. 9A–10A was derived from an approximation made up of a set of discrete bends indicated by the dotted lines in FIGS. 10 and 10A. The preferred positions of these bends (each one bent 10 degrees in this case, except at edge 165) are indicated graphically in FIG. 11. The procedure used to select this pattern was one of progressive approximation, gradually adjusting the positions and aggregate magnitude of the bends in order to have the tape pass perpendicularly around edge 165, which is inclined at angle A, and pass through both openings 190 and 188 without touching the housing or the spool or experiencing any substantial edgewise deflection. The same procedure could be used for different values of A, although the size of opening 190 might need to be varied.

The degree to which burnishing member 198 deflects when edge 165 is pressed against a surface can be varied in order to provide a more ergonomic dispenser. The head can be designed to provide flexing of burnishing member 198 about an axis that is parallel to the edge 165 (referred to herein as "flat-wise flexure"), about an axis that is perpendicular to the edge 165 and housing axis CL (referred to herein as "edge-wise flexure"), or both. If flatwise flexure occurs in varying degrees along the edge due to uneven pressure or support along the edge, this uneven flatwise flexure may also provide a degree of twist flexure about an axis of twist (FIG. 14A). If edge 165 is flexibly supported so that flatwise flexure can occur in a continuously varying manner from point to point along the edge, this variation in flatwise flexure can also provide a degree of accommodation to unevenness in the substrate to which the tape is being applied. Alternatively, if it is desired that edge 165 be capable of maintaining firm pressure along its entire length when it is pressed against a flat surface, then the region immediately behind edge 165 may be designed as a reinforced "straight-edge" structure, i.e., the thickness of burnishing member 198 is locally increased immediately behind edge 165 as shown in, e.g., FIG. 13A.

Figure 12:
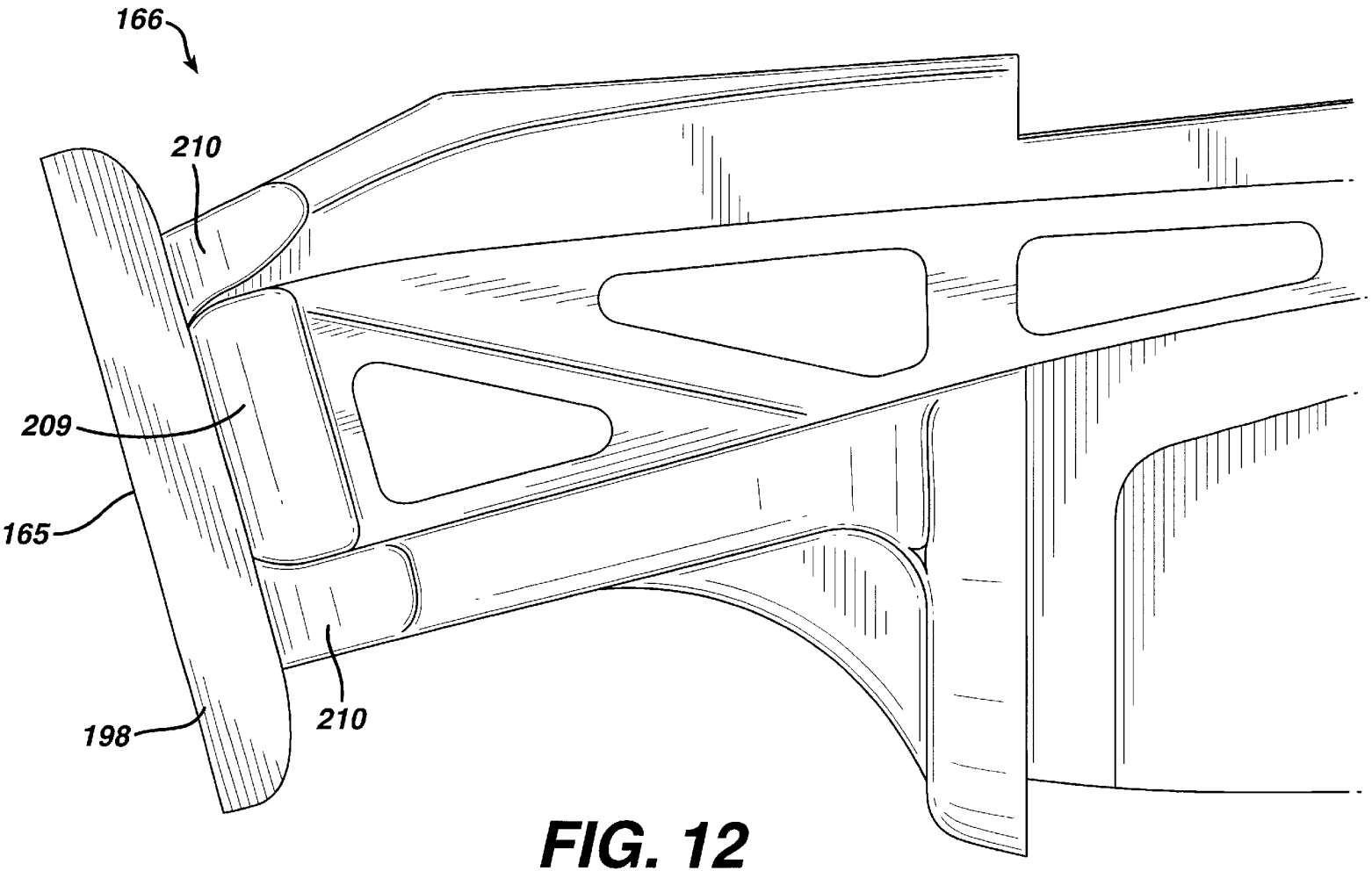
FIG. 12 is a partial enlarged side view of a tip portion according to one embodiment of the invention.

In one embodiment, shown in FIG. 12, the burnishing member 198 is mounted on a solid molded structure 209 having stiffening ribs 210 that define the borders of the tape bed 200. This arrangement provides a dispenser that has a relatively rigid head with little flat-wise or edge-wise flexure.

Figure 13:
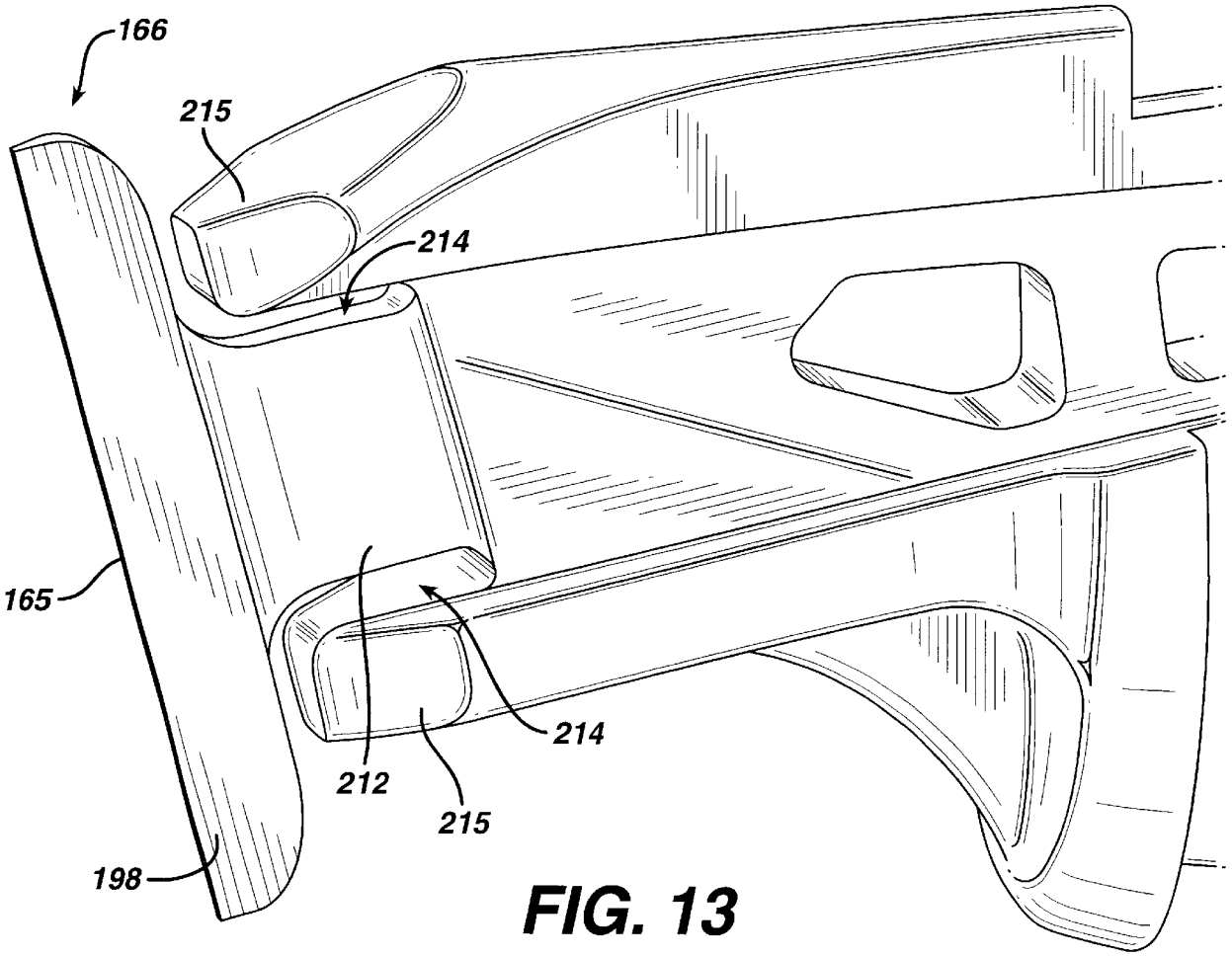
FIG. 13 is a partial enlarged perspective view of a tip portion according to an alternate embodiment of the invention.
Figure 13A:
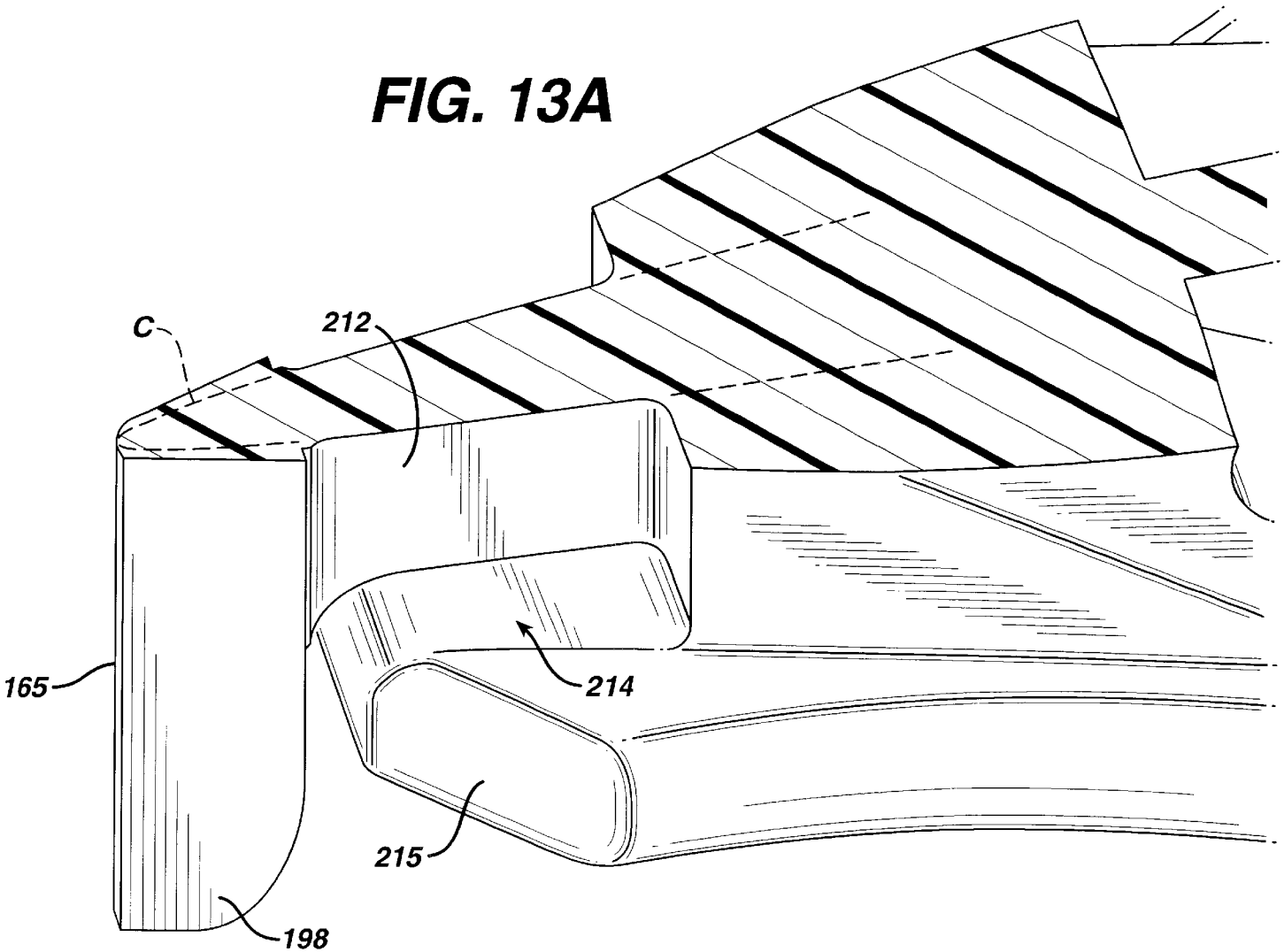

If more flat-wise flexure is desired, the burnishing member 198 can be mounted on a central tongue 212 that is thinned with respect to the tape bed 200 (i.e., the tongue thickness in the dimension perpendicular to edge 165 and housing axis CL is reduced relative to that of the tape bed), and cantilevered out from the tape bed 200, as shown in FIGS. 13 and 13A. The tongue should have a sufficiently high section modulus and flexural strength so that it will not suffer permanent deformation during normal use. A suitable material is polycarbonate.

The section modulus, defined as the section moment divided by the greatest distance of any strain-bearing material from its neutral axis, is the structural property of a cross-section which, combined with the elastic modulus of the material, will predict the maximum level of strain imposed by a given bending moment, under conventional linear assumptions of solid mechanics. For a cantilevered structure such as this tongue, in which it is desired to maximize both compliance and robustness, it is advantageous that the section modulus increase linearly with increasing distance from the edge, so that the portion of the structure bearing the highest leverage during flexure will have the highest section modulus (i.e., so that every portion contributes as much compliance as its material strength allows, with no portion avoiding the strain borne by other portions). For a structure of rectangular cross-section, the section modulus is proportional to the width and to the square of the thickness. Consequently, if the tongue has a uniform width it will have a substantially linearly increasing section modulus over portions where it has a substantially parabolic axial section as shown in FIG. 13A (see curve C). The function defining the parabolic curve is $Y=kX^{1/2}$, where Y is the thickness of the tongue, X is the distance from edge 165, and k is a constant chosen to match the material properties to the expected load. More generally, it is preferred that tongue 212 becomes progressively thicker as it extends away from edge 165, to provide adequate strength to withstand the leverage experienced at a given distance from the edge. However, it is also preferred that the tongue be sufficiently thin overall so that it will flex readily, i.e., so that the tongue will have a relatively low section moment.

To achieve adequate section modulus without undesirably increasing the section moment, it is generally preferred that the tongue be as wide as possible while still allowing sufficient clearance for the tongue to flex. However, the width of the tongue is generally constrained by side rails 215, which, like stiffening ribs 210, discussed above, are provided to act as curbs to help keep the tape on course on the tape bed. If side rails 215 are included, as shown, the width of the tongue is preferably from about 3 to 4 mm. In some embodiments, the side rails 215 may be omitted (e.g., if they are not needed to keep the tape on the tape bed), in which case the tongue may be wider, e.g., from about 4 to 8 mm. Preferably, the slots 214 that define the side edges of the tongue extend back from edge 165 far enough to form a tongue having a deflection that gives users a comfortable level of flexure without the tongue having to bend so sharply as to overstrain the material, e.g., about 3 to 6 mm, more preferably about 4 to 5 mm.

Figure 14:
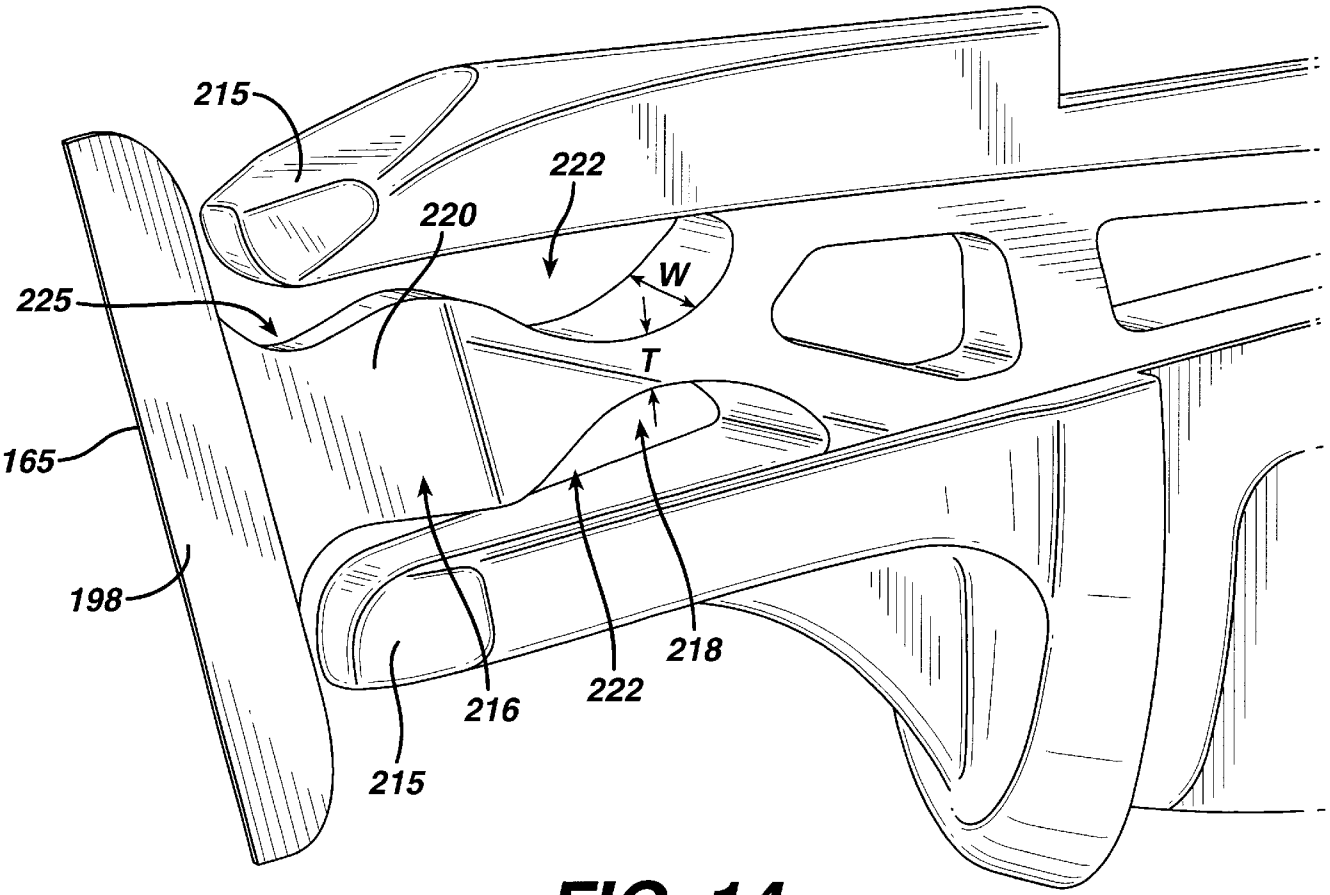
FIG. 14 is a partial enlarged perspective view of a tip portion according to another alternate embodiment of the invention.
Figure 14A:
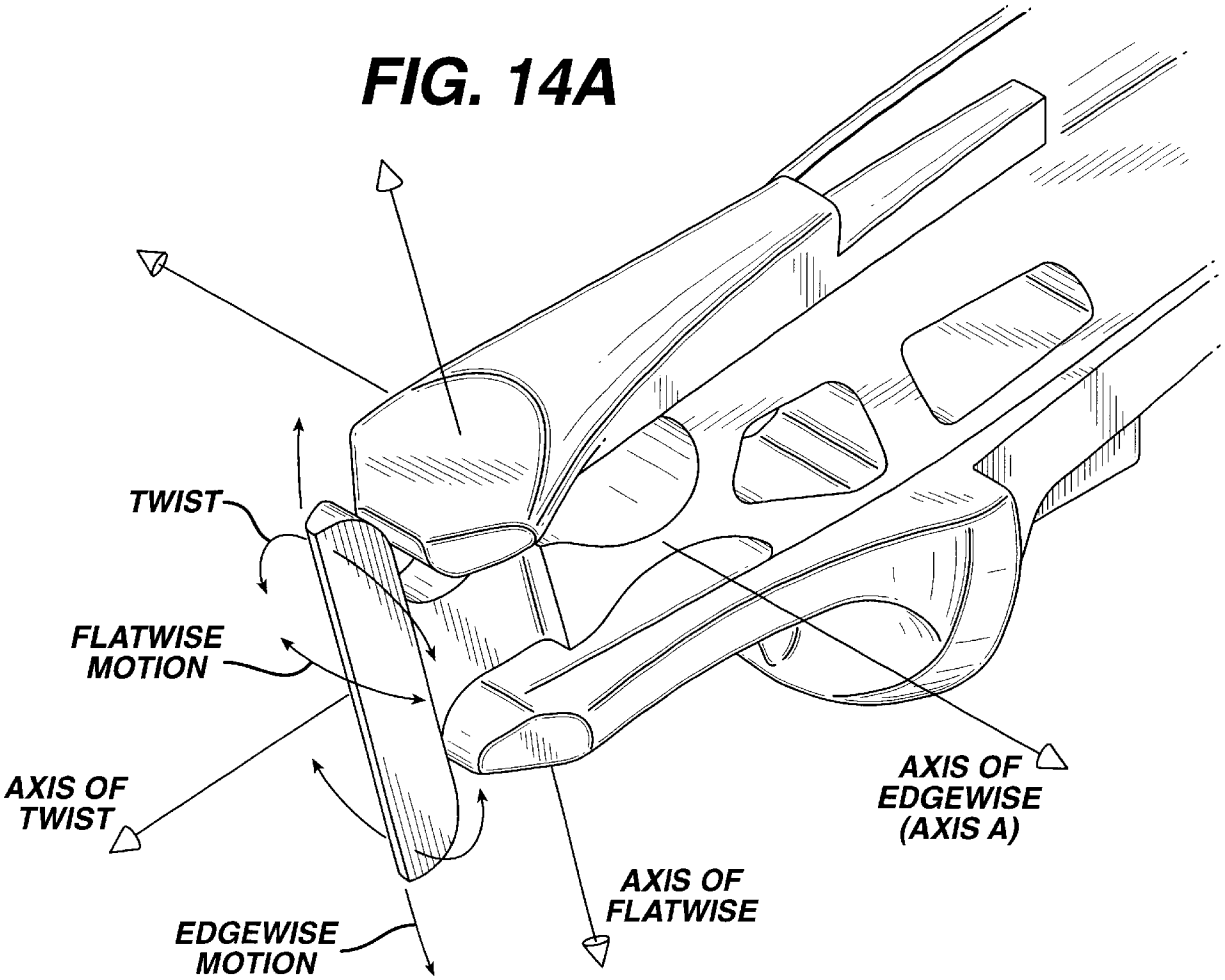

If it is desired that the dispenser head have substantial edge-wise flex, in addition to its flat-wise flex, the burnishing member 198 may be mounted on a longer tongue 216, as shown in FIG. 14. As shown, tongue 216 has a substantially hour-glass shaped profile. The neck region 218 of tongue 216 is thinner (i.e., smaller in the dimension that is parallel to edge 165) than the rest of the tongue (e.g., thickness T, FIG. 14, is about 0.8 mm, vs. 4 mm for the rest of the tongue). Thus, neck region 218 has a relatively low section moment about the axis of edgewise rotation (axis A, FIG. 14A), allowing the front portion 220 of the tongue, and thus the burnishing member 198, to pivot about axis A when an edge-wise load is applied to edge 165. The width W (FIG. 14) of neck region 218 (i.e., the dimension parallel to axis A) is much greater than the thickness in this area (e.g., the width is about 5 mm vs. the thickness of about 0.8 mm noted above), so that this "hinge" region remains robust against sideways loads. It is generally preferred, as shown in FIG. 14, to also include a second, wider neck region 225, to allow sufficient clearance for the tongue to flex edgewise without hitting side rails 215.

Preferably, the narrowest point of this neck region 216 is located near enough to edge 165 that the pivoting of the tongue will tend to provide a balanced burnishing pressure across the breadth of the tape, pivoting readily in response to pressure forces from the page exerted in a direction normal to edge 165 and less readily in response to incidental frictional forces exerted parallel to edge 165. On the other hand, the narrowest point of the neck region is located far enough from edge 165 so that the tape path can swing up and down, to a limited extent, with the pivoting tongue and minimize the degree to which the edge 165 goes out of square with respect to the tape passing around it. Based on these constraints, the distance from the narrowest point of the neck region to edge 165 is preferably about 5 to 15 mm, more preferably about 9 to 11 mm.

Figure 15:
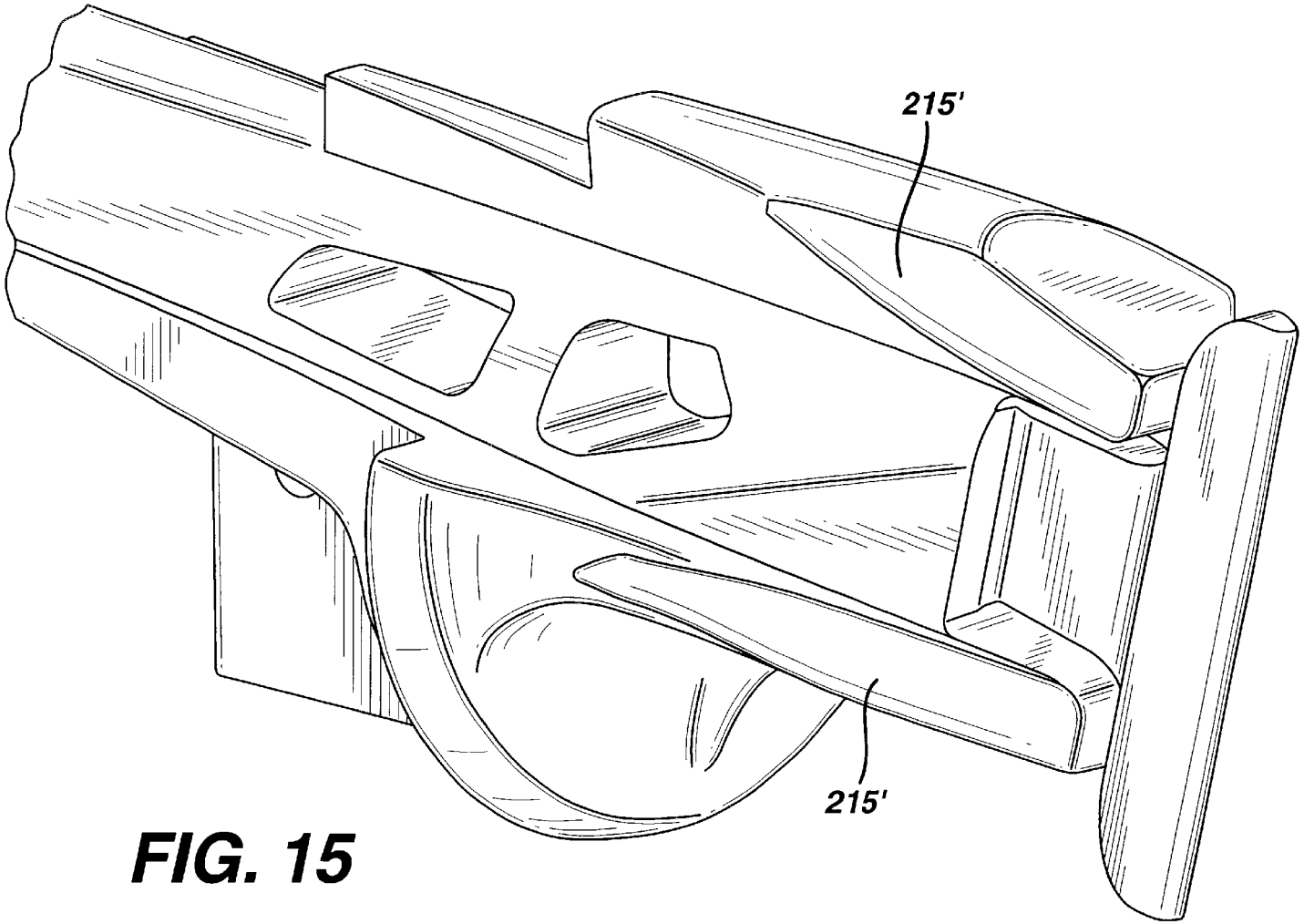
FIG. 15 is a partial enlarged perspective view of a tip portion according to another alternate embodiment of the invention.

The stiffening ribs 210, or side rails 215, may be of any desired height, or may be omitted entirely, depending upon whether it is preferred to constrain the course of the tape more positively, or to allow the tape more freedom of movement from its course. Allowing the tape some freedom of movement may cause less pressure against the edges of the tape and thereby reduce the risk of damage to the coating layer of the tape. For example, side rails 215' may be relatively low, as shown in FIG. 15. The side rails may be provided on only one side of the tip, e.g., the take-up side, or may be provided on both sides.

In some embodiments, it is preferred that the tape guides 270, 274 have a curved surface over which the tape passes, as shown in FIGS. 16–20. This curved surface allows the tape to remain relatively centered on the tape guide even though tape in alternate layers on the supply spool approaches the tape guide from different angles. (If the tape is wound in helical layers on the supply spool, the tape will come off the spool at an oblique angle as it is used, and this angle will reverse from one layer to the next. In some embodiments, for example, the helical slope is about 15 degrees, so that tape unwinding from the "odd-numbered" layers of the supply windings will be arriving at the supply guide from a direction about 15 degrees to one side of a plane perpendicular to the spool axis, and tape unwinding from the "even-numbered" layers will be arriving from about 15 degrees to the other side of such a plane. If the takeup windings are patterned after the supply windings, due to the coordinated motion of the supply and takeup spools, there will also be a similar alternation in the angles at which the backing is wound onto the takeup spool.) In order to accommodate this difference in directions of tape travel, the edge of each guide is curved in a crescent shape so that, under the tension maintained by the clutch, the tape will act in a self-centering manner. Thus, the tape will adjust its position on the tape guide so as to maintain the shortest path length but will still stay substantially centered, i.e., not straying beyond either end of the guide edge.

Figure 16:
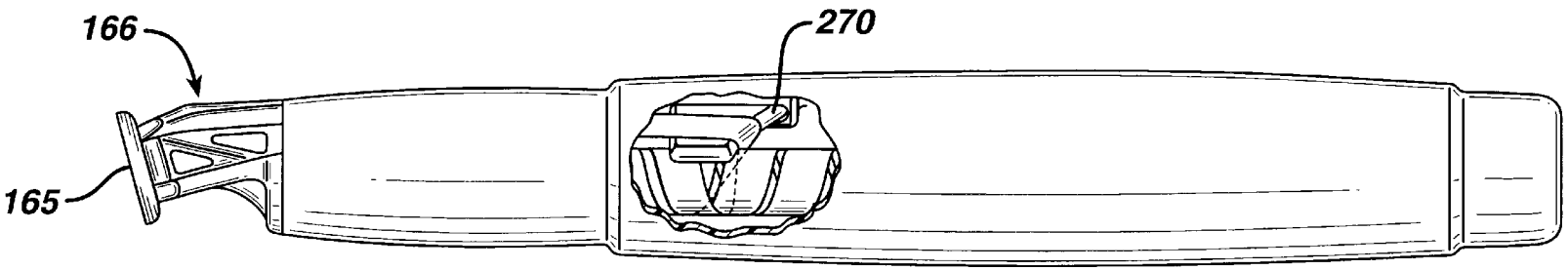
FIG. 16 is a partially cut-away side view of a tape dispenser.
Figure 17:
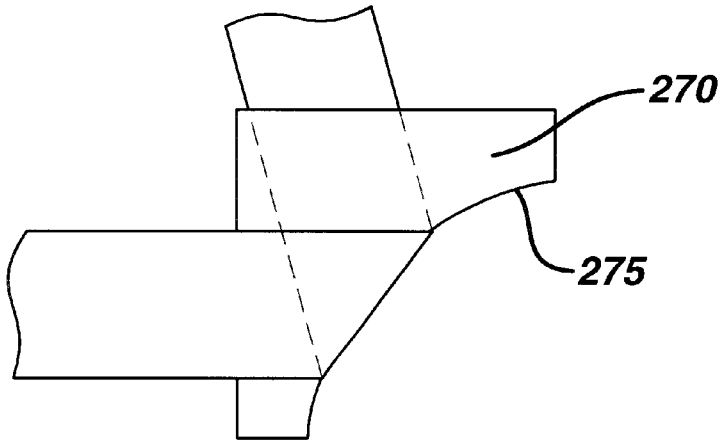
FIGS. 17 and 18 are highly enlarged schematic views illustrating the different paths taken over a tape guide by tape from alternate layers of helical windings.
Figure 18:
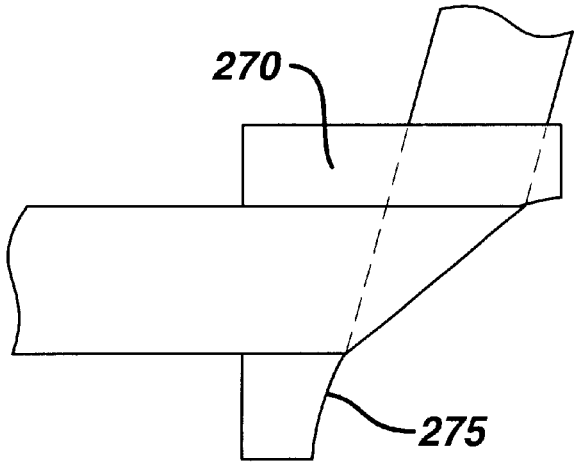
Figure 19:
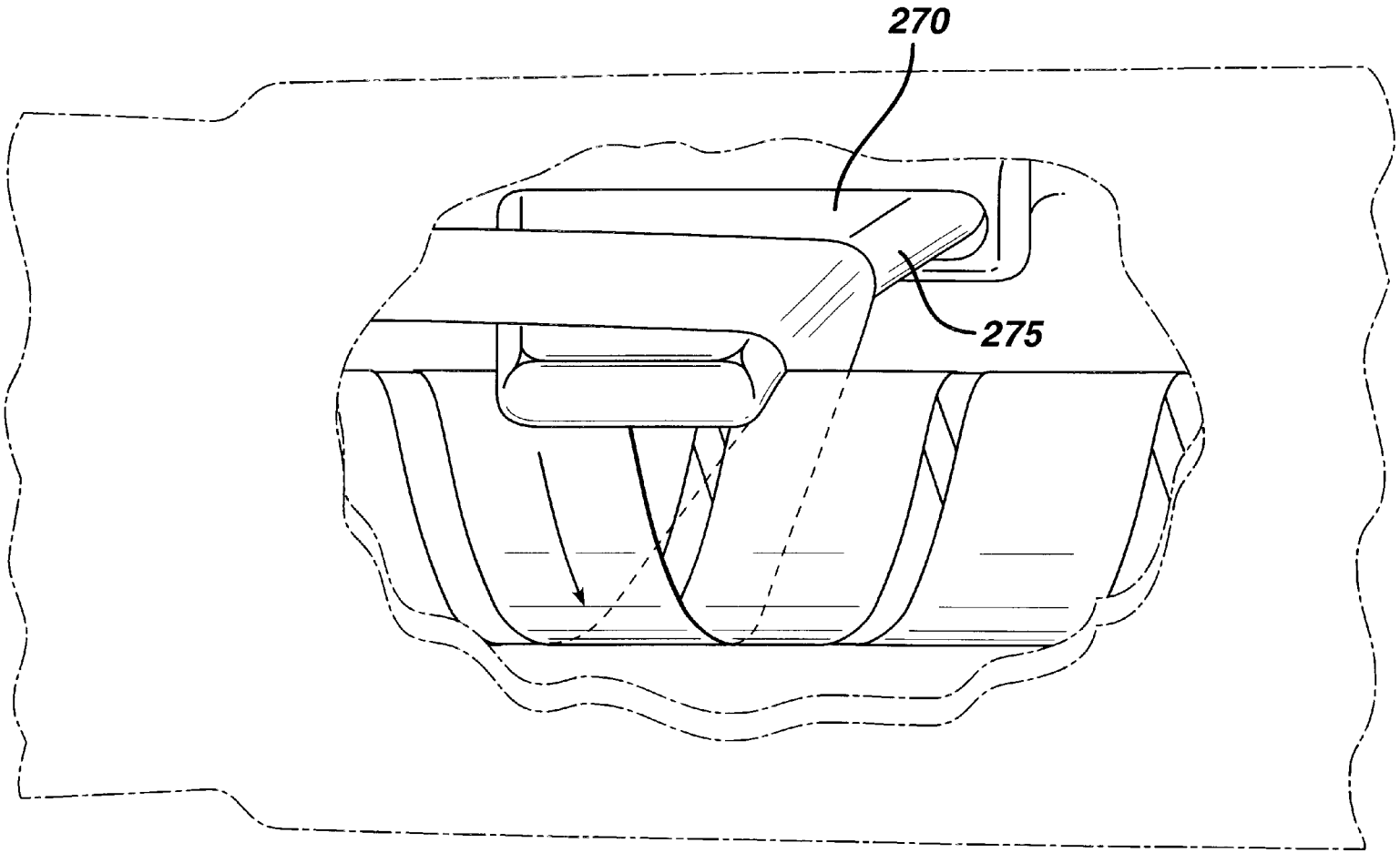
FIGS. 19 and 20 are highly enlarged perspective views showing the different paths taken over the tape guide shown in the cut-away area of FIG. 16 by tape from alternate layers of helical windings.
Figure 20:
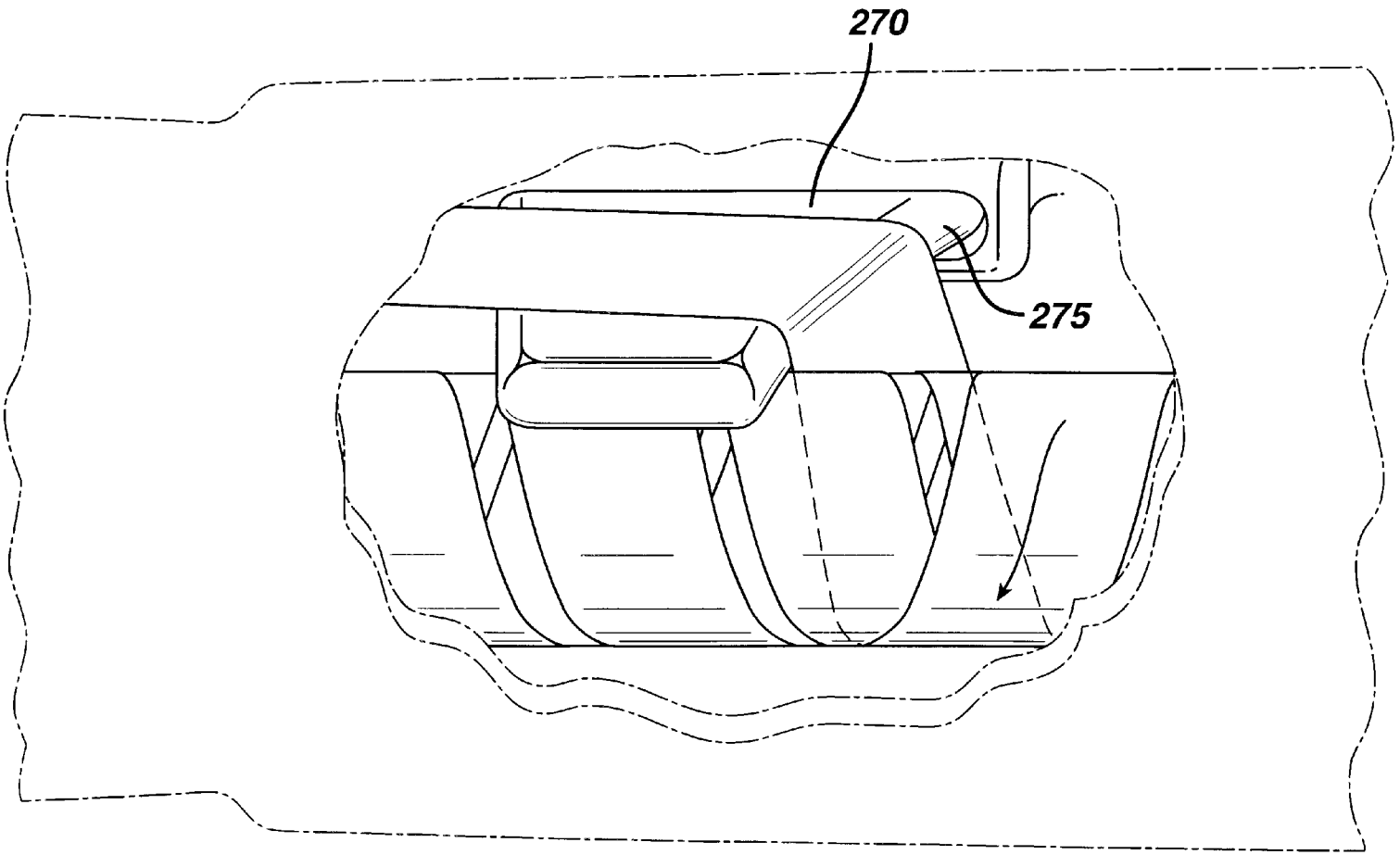

FIG. 16 shows a dispenser with a portion cut away to show the tape guide 270 with tape passing over it. FIGS. 17 and 18 illustrate schematically the adjustment of the tape position on the curved edge 275. The cut away region of FIG. 16 is shown enlarged in FIGS. 19 and 20, illustrating the two different tape arrival directions corresponding to the different helix angles of alternating layers of tape windings.

Referring to FIGS. 17 and 18, when the tape's bend at the guide forms an obtuse angle as in FIG. 18, the oblique fold in the tape as it passes over the crescent edge becomes longer than in the acute-angle case, shown in FIG. 17. Under certain conditions of tape tension and tape composition, this extended fold can be vulnerable to buckling or wrinkling since its mid-region is not closely supported, due to the concave curvature of the crescent guide edge. To better support the tape, the edge 275 may have a nonuniform edge curvature, so as to reduce the concavity of the portion where this longer fold sits, since the acute bend and the obtuse bend tend to rest at different places on the edge 275. For example, in a suitable edge geometry the portion of the edge where the longer fold sits is straight, and the portion where the shorter fold sits is curved somewhat more sharply than in a uniformly-curved version, so as to present substantially the same total curvature as in a uniformly-curved version.

Other embodiments are within the scope of the following claims.

For example, rather than applying a white, opaque transfer layer to a surface, a tinted transparent highlight layer or other type of layer can be applied.

Also, the dispenser may utilize only one spool such as a single supply spool, which can deliver a backingless tape, or a single take-up spool, which can be driven by a roller applicator head. In a two-spool dispenser, the spool that is closest to the tip may be either the supply spool or the take-up spool.

Moreover, when the tape is wound in a helical pattern on one or both of the spools, the turns of the helical pattern can be spaced either so that there is little or no overlap between the turns, or so that each turn overlaps one or more adjacent turns. If there is no overlap, both edges of the tape will be wound on the same diameter, which may be advantageous if the tape is relatively inelastic, so that a discrepancy between the winding diameters for the two edges of the tape would tend to cause wrinkles in the less taut edge. If the tape is wound so that adjacent turns overlap, the slope at which the helix spirals will be minimized, and the edge of the tape which overlaps the preceding turn will be wound on a slightly larger diameter than the other edge. This option would be preferred when the magnitude of the helix slope is found to be a severe design constraint, for example because of difficulty accommodating the two opposite alternating helix slopes where the tape encounters the tape guides 270 and 274. Generally, it is preferred that the overlap between adjacent turns be from about 10 to 40 percent of the tape width. The tape may be wound on the spool with the transfer layer facing inwards (towards the surface of the spool) or outwards. The geometry of tape guide 270 that is illustrated in FIGS. 16–20 is for use with inward facing tape. For outward facing tape, it may be advantageous for spatial reasons to have the tape make a broad turn as it comes off the supply spool. This turn may be best supported by a guide having a broader concave supporting surface, e.g., a more saddle-shaped guide.

In addition, the burnishing edge over which the tape passes may have a smoother or sharper curvature, relative to the embodiments shown in FIGS. 1–15 and discussed above. Generally, a smoother curvature will allow the edge to move more smoothly over a substrate, while a sharper curvature will provide a higher application pressure by concentrating the force applied by the user into a narrower band of contact.

What is claimed is:

1. A dispenser for applying a material to a surface, comprising:

a housing, at least a major portion of which is substantially cylindrical;

within the housing, a supply spool rotatable about an axis and a quantity of material stored on the supply spool in a plurality of widths wide; and at one end of the housing, an applicator head about which the material is passed, the head being constructed to press the material against the surface, the head having an edge, over which the material passes, that is disposed at an angle of greater than 5 degrees relative to a plane that is perpendicular to the longitudinal center axis of the housing.

2. The dispenser of claim 1 wherein the edge is disposed at an angle of greater than 10 degrees relative to said plane.

3. The dispenser of claim 1 wherein the edge is disposed at an angle of from about 5 to 30 degrees relative to said plane.

4. The dispenser of claim 3 wherein the edge is disposed at an angle of from about 10 to 20 degrees relative to said plane.

5. The dispenser of claim 1 wherein the edge is disposed at an angle of about 15 degrees relative to said plane.

6. The dispenser of claim 1 wherein the longitudinal center axis of the housing passes within 1 mm of the lengthwise midpoint of said edge.

7. The dispenser of claim 6 wherein the longitudinal center axis of the housing passes through the lengthwise midpoint of said edge.

8. The dispenser of claim 1 wherein said applicator head exhibits flat-wise flexure when pressed against a surface.

9. The dispenser of claim 1 wherein said applicator head exhibits edge-wise flexure when pressed against a surface.

10. The dispenser of claim 8 or 9 wherein said edge is defined by a member that is mounted on a flexible tongue.

11. The dispenser of claim 1 wherein said material is a correction tape.

12. The dispenser of claim 1 wherein the applicator head is constructed to pivot about an axis.

13. The dispenser of claim 12 wherein the applicator head pivots about the axis of rotation of the supply spool.

14. A dispenser for applying a material to a surface, comprising:

a housing, at least a major portion of which is substantially cylindrical;

within the housing, a supply spool rotatable about an axis and a quantity of material stored on the supply spool in a plurality of widths wide, the axis of rotation of the spool being substantially parallel to the longitudinal axis of the housing; and at one end of the housing, an applicator head about which the material is passed, the head being constructed to press the material against the surface, the head having an edge, over which the material passes, that is positioned so that its lengthwise midpoint is in the vicinity of the longitudinal center axis of the housing so that the housing will not rotate to any significant extent about its longitudinal center axis when the edge is pressed against a surface during use.

15. The dispenser of claim 14 wherein the midpoint is within 1 mm of the longitudinal center axis.

16. The dispenser of claim 15 wherein the midpoint lies on the longitudinal center axis.

17. The dispenser of claim 14 wherein said material is a correction tape.

18. A dispenser for applying a material to a surface, comprising:

a housing, at least a major portion of which is substantially cylindrical;

within the housing, a supply spool rotatable about an axis and a quantity of material stored on the supply spool in a plurality of widths wide, the axis of rotation of the spool being substantially parallel to the longitudinal axis of the housing; and at one end of the housing, an applicator head about which the material is passed, the head being constructed to press the material against the surface, the head having a burnishing member defining an edge, over which the material passes, the burnishing member being mounted on a cantilevered tongue so as to allow the burnishing member to flex flat-wise when the edge is pressed against a surface.

19. The dispenser of claim 18 wherein the tongue is constructed to allow the burnishing member to flex edge-wise when the edge is subjected to an edge-wise load.

20. The dispenser of claim 18 wherein said edge is disposed at an angle of greater than 5 degrees relative to a plane that is perpendicular to the longitudinal center axis of the housing.

21. The dispenser of claim 18 wherein the longitudinal center axis of the housing passes within 1 mm of the lengthwise midpoint of said edge.

22. The dispenser of claim 18 wherein the longitudinal center axis of the housing passes through the lengthwise midpoint of said edge.

23. A dispenser for applying a material to a surface, comprising:

a supply spool rotatable about an axis;

a quantity of unused tape stored on the supply spool;

a housing which surrounds at least a majority of the tape, a substantial portion of the housing being substantially cylindrical in shape, the housing defining a longitudinal center axis;

an applicator head about which the tape is passed, the head passing the tape against the surface to deposit a transfer layer of the tape onto the surface, the head defining an edge over which the tape passes, the edge being disposed at an angle of greater than 5 degrees relative to a plane that is perpendicular to the longitudinal center axis of the housing; and a support surface constructed to support the tape as it moves from the supply spool to the edge in a manner that prevents the tape from being subjected to a significant edgewise load.

24. The dispenser of claim 23 wherein said support surface comprises a substantially continuous surface.

25. The dispenser of claim 24 wherein said support surface comprises a ramped portion and a conical portion.

26. The dispenser of claim 23 wherein said support surface comprises a discontinuous, segmented surface.

27. The dispenser of claim 26 wherein said segmented surface comprises a series of spaced guides, posts or pegs.

28. A dispenser for applying a material to a surface, comprising:

a supply spool rotatable about an axis;

a quantity of unused tape stored on the supply spool;

an applicator head about which the tape is passed, the head pressing the tape against the surface to deposit a transfer layer of the tape onto the surface, the head defining an edge over which the tape passes;

a housing which surrounds at least a.majority of the tape; and a support surface positioned between the supply spool and the edge for engaging a face of the tape, the support surface being shaped to change an orientation of a vector normal to the plane of the tape from substantially parallel to the edge to substantially perpendicular thereto over an axial distance of less than about 30 mm.

29. The dispenser of claim 28 wherein the longitudinal axis of the tape is curved during the change of orientation.

30. The dispenser of claim 28 wherein the housing defines a longitudinal axis and the support surface is configured to allow the change of orientation to occur within a radial distance of less than about 5 mm from the longitudinal axis of the housing.

31. A dispenser for applying a material to a surface, comprising:

a supply spool rotatable about an axis;

a quantity of unused tape stored on the supply spool:

a housing which surrounds at least a majority of the tape, a substantial portion of the housing being substantially cylindrical in shape, the housing defining a longitudinal center axis;

an applicator head about which the tape is passed, the head pressing the tape against the surface to deposit a transfer layer of the tape onto the surface, the head defining an edge over which the tape passes, the edge being disposed at an angle of greater than 5 degrees relative to a plane that is perpendicular to the longitudinal center axis of the housing; and a support surface constructed to support the tape as is moves from the supply spool to the edge, the support surface being configured so that both edges of the tape travel the same path length as the tape moves between the supply spool and the edge.

32. The dispenser of claim 18, 23, 28 or 31, wherein the material comprises a correction tape, carrying a transfer layer on one surface.

33. The dispenser of claim 32 wherein the support surface is configured to support the tape only on the surface opposite the surface carrying the transfer layer.

34. The dispenser of claim 1, 14, 18, 23, 28 or 31 wherein the edge has a length of at least 9 mm.

35. The dispenser of claim 34 wherein the edge has a length of from about 9 to 15 mm.

36. The dispenser of claim 35 wherein the edge has a length of from about 10 to 12 mm.

37. The dispenser of claim 1, 14 or 18 wherein said material is wound helically on said supply spool.

38. The dispenser of claim 37 wherein adjacent windings of the material overlap each other by from about 10 to 40 percent of the width of the material.

39. The dispenser of claim 23, 28 or 31 wherein said tape is wound helically on said supply spool.

40. The dispenser of claim 39 wherein adjacent windings of the tape overlap each other by from about 10 to 40 percent of the width of the material.

41. The dispenser of claim 1, 14, 18, 23, 28 or 31 wherein at least a portion of the applicator head is transparent.

42. The dispenser of claim 1, 14 or 18 further comprising one or more tape guides that reorient the material as it travels from the supply spool to the head.

43. The dispenser of claim 42 wherein the tape guides comprise a low surface energy material.

44. The dispenser of claim 43 wherein said low surface energy material comprises polytetrafluoroethylene (PTFE).

45. The dispenser of claim 23, 28 or 31 further comprising one or more tape guides that reorient the tape as it travels from the supply spool to the head.

46. The dispenser of claim 45 wherein the tape guides comprise a low surface energy material.

47. The dispenser of claim 46 wherein said low surface energy material comprises polytetrafluoroethylene (PTFE).

48. The dispenser of claim 42 wherein the tape guides include a surface with a concave aspect over which the material passes.

49. The dispenser of claim 45 wherein the tape guides include a surface with a concave aspect over which the tape passes.

* * * * *

UNITED STATES PATENT AND TRADEMARK OFFICE

CERTIFICATE OF CORRECTION

PATENT NO. : 6,601,631 B1 
DATED : August 5, 2003
INVENTOR(S) : Crispin R. Miller et al.

It is certified that error appears in the above-identified patent and that said Letters Patent is hereby corrected as shown below:

Column 16,
Line 40, please delete "a.majority" and insert -- a majority --.
Lines 42-44, please delete "a support surface positioned between the supply spool and the edge for engaging a face of the tape, the support surface being shaped to change" and insert -- a support surface extending from the supply spool to the edge and constructed to support a face of the tape as it moves from the supply spool to the edge and in addition being shaped to change --.

Column 17,
Lines 4-5, please delete "tape as is moves" and insert -- tape as it moves --.

Signed and Sealed this

Thirteenth Day of January, 2004

JON W. DUDAS
*Acting Director of the United States Patent and Trademark Office*